US006659258B2

(12) United States Patent
Otsuka

(10) Patent No.: US 6,659,258 B2
(45) Date of Patent: Dec. 9, 2003

(54) PAPER-LIKE MATERIAL PROCESSING APPARATUS

(75) Inventor: Toru Otsuka, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 101 days.

(21) Appl. No.: 10/086,438

(22) Filed: Mar. 4, 2002

(65) Prior Publication Data

US 2002/0153290 A1 Oct. 24, 2002

(30) Foreign Application Priority Data

Apr. 19, 2001 (JP) ..... 2001-121258

(51) Int. Cl.[7] ..... G07F 7/04; B07C 5/34; B65H 39/10

(52) U.S. Cl. ..... 194/206; 209/534; 270/58.08

(58) Field of Search ..... 270/58.01, 58.07, 270/58.08, 58.09, 58.11; 271/902, 225, 184, 185, 186; 414/791.2; 53/399, 447; 194/206; 209/534

(56) References Cited

U.S. PATENT DOCUMENTS 4,739,156 A * 4/1988 Watanabe ..... 235/379
4,825,378 A * 4/1989 Yuge ..... 700/223
4,856,768 A * 8/1989 Hiroki et al. ..... 271/186
5,092,236 A * 3/1992 Prim et al. ..... 100/220
5,247,159 A * 9/1993 Yuge et al. ..... 235/379
5,468,941 A * 11/1995 Sasaki ..... 235/379
6,513,303 B2 * 2/2003 Neri ..... 53/399
6,550,621 B2 * 4/2003 Fukatsu et al. ..... 209/534

FOREIGN PATENT DOCUMENTS

JP 5-6478 1/1993
JP 5-159136 A * 6/1993 ..... G07D/13/00

OTHER PUBLICATIONS

Abstract of reference or above.

* cited by examiner

*Primary Examiner*—Donald P. Walsh
*Assistant Examiner*—Mark J Beauchaine
(74) *Attorney, Agent, or Firm*—Pillsbury Winthrop LLP

(57) ABSTRACT

The paper-like material processing apparatus having back-ups for loading stacked paper-like materials respectively in the two stackers that the stacked paper-like materials on the backups are transferred to one carrier and conveyed to a single banding mechanism, wherein the apparatus has a temporarily holding mechanism for receiving and holding the stacked paper-like materials from the backups when the carrier is in use and a delivery mechanism for transferring the stacked paper-like materials of the temporarily holding mechanism to the carrier and transfers the stacked paper-like materials to the carrier when the carrier becomes usable.

13 Claims, 15 Drawing Sheets

PAPER-LIKE MATERIAL PROCESSING APPARATUS

CROSS-REFERENCE TO RELATED APPLICATIONS

This application is based upon and claims the benefit of priority from the prior Japanese Patent Application No. 2001-121258, filed on Apr. 19, 2001: the entire contents of which are incorporated herein by reference.

BACKGROUND OF THE INVENTION

1. Field of the Invention

The present invention relates to a paper-like material processing apparatus that a plurality of banknotes of a plurality of money kinds are inserted together into an insert port and classified and stacked into front and back for each money kind, and stacked banknotes of a specific money kind are banded with a paper strip for each predetermined number of banknotes or stacked for each money kind, and the stacked banknotes of each money kind are banded with a paper strip for each predetermined number of banknotes.

2. Description of the Related Art

In a conventional paper-like material processing apparatus, for example, a banknote processing apparatus, a plurality of banknotes of a plurality of money kinds are mixed in a confusion state of "front and back" and "top and bottom" (upright banknote pattern state and reversed state) and inserted into an insert port. The inserted banknotes are taken out and conveyed on the conveying path one by one and characteristics such as money kind, front and back, and top and bottom of each conveyed banknote are detected. An apparatus is known that the front and back of each banknote are selectively reversed on the basis of the detection results and all the banknotes are distributed and stacked in a predetermined stacker prepared for each money kind with the front positioned up.

Particularly, as an apparatus having a function for banding banknotes of a specific money kind with a paper strip, the banknote processing apparatus disclosed in Japanese Patent Publication 5-6478 is known.

This apparatus has two stackers for stacking banknotes of a specific money kind. Banknotes sent in a state that the front is positioned up and the upper end is positioned at the top are stacked in one of the stackers. Banknotes sent in a state that the front is positioned up and the lower end is positioned at the top are stacked in the other stacker. Namely, in each stacker, the "front and back" and "top and bottom" of each banknote are arranged properly. And, each banknote is banded with a paper strip in a banding portion installed in correspondence with each stacker. In this case, in each banding portion, a paper strip is wound at the biased position on one end of a predetermined number of stacked banknotes in the longitudinal direction so as to bind the banknotes.

However, in the aforementioned conventional banknote processing apparatus, for example, banknotes stacked in each stacker at the biased position on the rear side of the apparatus are wound with a paper strip, so that the banknotes stacked in one stacker and the banknotes stacked in the other stacker are in a reversed state of top and bottom. Therefore, the paper strip winding position is different. When the paper strip winding position is different like this, for example, in one of the stackers, a fault may be caused that the portrait, numeral, and characters printed on the banknote surface may be hidden with a paper strip.

Therefore, a method for arranging one of the banding devices installed in correspondence with the respective stackers on the front side of the apparatus and the other on the rear side thereof, thereby winding a paper strip at the same position may be considered. However, to adopt such a constitution, a problem arises that banding devices having different structures must be prepared and the cost is increased.

SUMMARY OF THE INVENTION

An object of the present invention is to provide a paper-like material processing apparatus for properly arranging the "front and back" and "top and bottom" of all paper-like materials without changing the apparatus constitution and banding all paper-like materials at the same position commonly by a single banding device.

According to embodiments of the present invention there is provided a paper-like material processing apparatus, comprising a discriminator to discriminate a kind of paper-like materials to be conveyed; a first stacker to stack the paper-like materials discriminated as a first kind on the basis of discrimination results of the discriminator; a second stacker to stack the paper-like materials discriminated as a second kind on the basis of the discrimination results of the discriminator; and a single banding mechanism to band respectively paper-like materials stacked in the first stacker and the second stacker.

DETAILED DESCRIPTION OF THE INVENTION

An embodiment of the present invention will be explained in detail hereunder with reference to the accompanying drawings.

Figure 1:
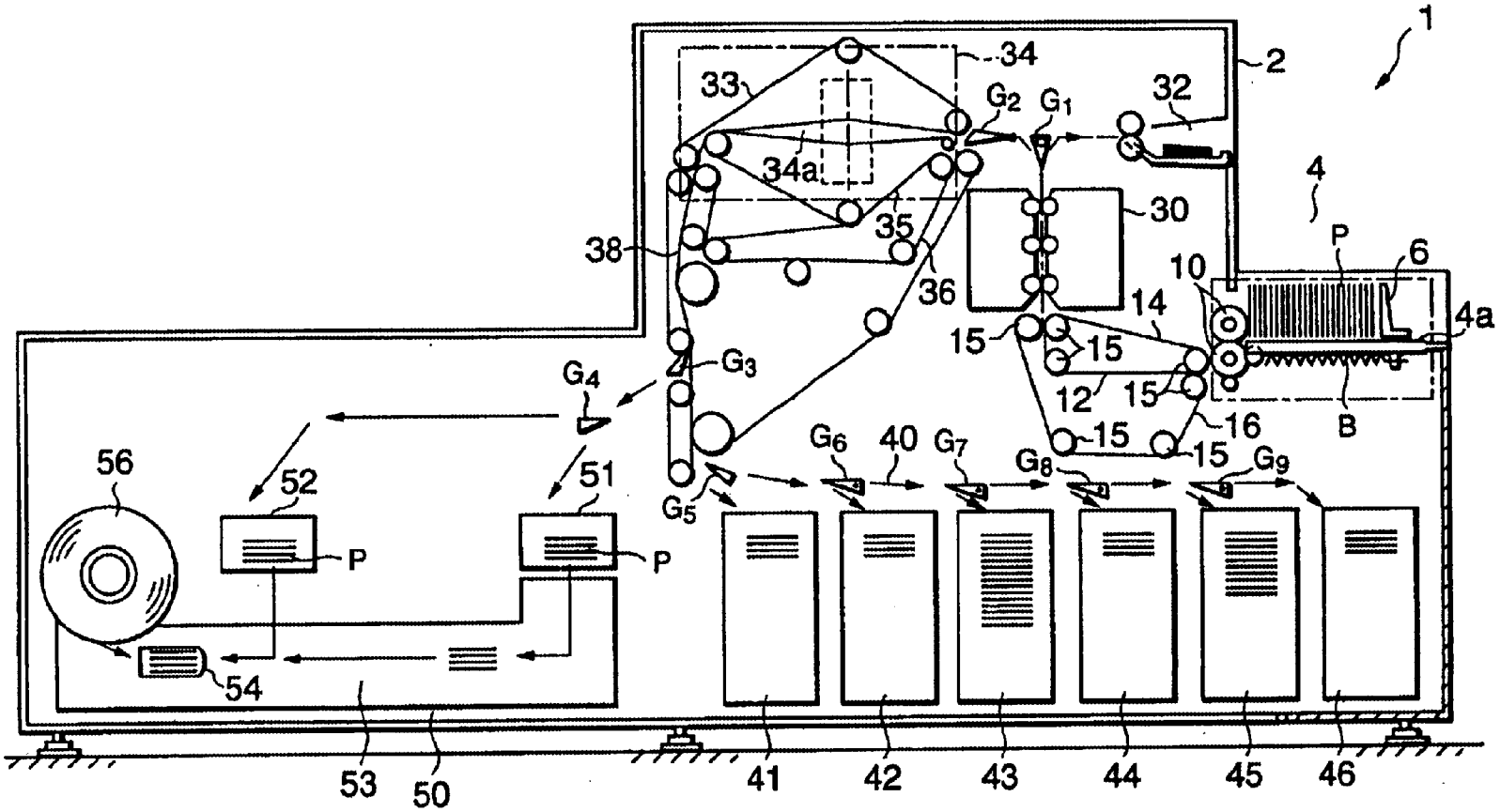
FIG. 1 is a schematic diagram showing the internal structure of a banknote processing apparatus as an embodiment of the paper-like material processing apparatus of the present invention.

FIG. 1 schematically shows the internal structure of a banknote processing apparatus 1 relating to an embodiment as a paper-like material processing apparatus of the present invention. In the banknote processing apparatus 1, a plurality of different-size banknotes of a plurality of money kinds are mixed and inserted in a batch, and all banknotes are properly arranged in front and back and classified and stacked for each money kind thereof. Further, the banknote processing apparatus 1 has a function for banding only banknotes of a specific money kind with a paper strip for each predetermined number of banknotes.

The banknote processing apparatus 1 has a frame 2 that is an outer shell of the apparatus. At the stepped part on the right of the frame 2 in the drawing, an insert port 4 where a plurality of banknotes P are stacked in the face direction and inserted together in an upright state is installed. The banknotes P respectively have the front and back and also have the upper and lower end extending along the longitudinal direction thereof. The banknotes P are inserted into the insert port in a posture that the upper end or lower end thereof is directed downward. The insert port 4 has a stage 4*a* on which all the banknotes P are positioned with the upper end or lower end thereof in contact with it. On the right end of the insert port 4 in the drawing, a backup plate 6 is installed upright in the perpendicular direction to the stage 4*a*. The backup plate 6 is installed so as to move in the left direction in the drawing along the stage 4*a* by the pressing force of a spring 8.

The plurality of banknotes P inserted upright into the insert port 4 are energized by the backup plate 6 in the face direction thereof and moved in the left direction in the drawing. And, the banknotes P at the left end in the drawing are pressed against two sets of take-out rollers 10 (take-out portion) arranged on the left side of the insert port 4 in the drawing in a state that they are mutually adjacent up and down. When the take-out rollers 10 are rotated in a predetermined direction, the plurality of banknotes P inserted upright into the insert port 4 are taken out on the conveying path 12 sequentially starting from the banknote P at the left end. The banknotes P taken out on the conveying path 12 are taken out in the transverse direction thereof with the upper end or lower end thereof positioned at the top. At this time, the front and back of each banknote are in the disordered state. In this embodiment, the take-out direction of the banknotes P from the insert port 4 is the downward direction.

The conveying path 12 is specified by conveying belts 14 and 16 stretched above and below the conveying path 12 so as to move endlessly along the conveying direction. The conveying belts 14 and 16 are wound on a plurality of rollers 15 installed in the width direction (paper face direction).

At the end of the conveying path 12 bent upward by the conveying belts 14 and 16, a detector 30 for detecting characteristics such as the money kind of the banknotes P, front and back, top and bottom, soil, and damage is arranged. The detector 30 reads various information from the surface of each of the banknotes P conveyed on the conveying path 12. The detector 30 carries out logic operations for the read information, compares the information with the standard information, and detects the aforementioned characteristics of the banknotes P.

The banknotes P inserted into the insert port 4 are in the disordered state of "front and back" and "top and bottom". Therefore, when the banknotes P are taken out on the conveying path 12, the direction of each of the banknotes P is in the disordered state of "front and back" and "top and bottom". Therefore, the banknotes P of a plurality of money kinds passing through the detector 30 are in the disordered state of "front and back" and "top and bottom".

Figure 2:
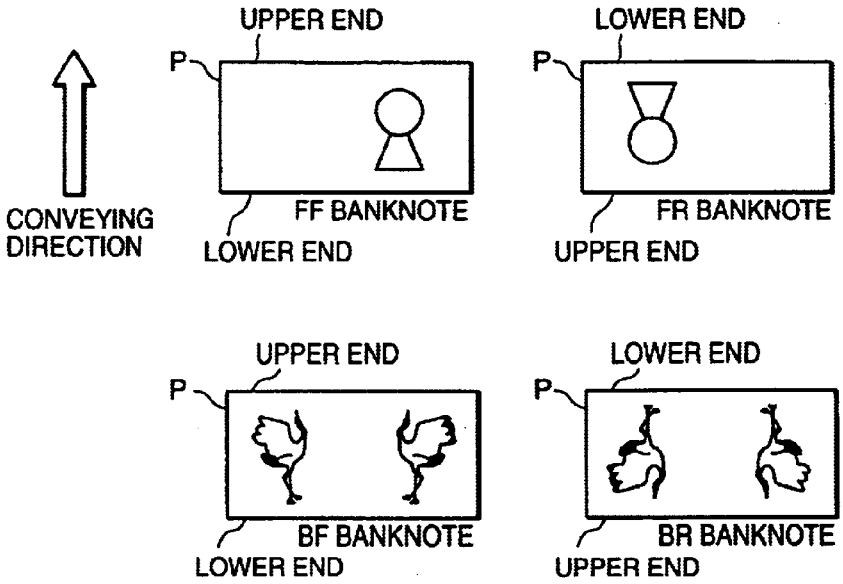
FIG. 2 is plan views for explaining the direction concerning the "front and back" and "top and bottom" of a banknote taken out from the insert port.

FIG. 2 shows 4 kinds of directions concerning the "front and back" and "top and bottom" of the banknotes P passing through the detector 30. In the following explanation, the banknotes P taken out in a state that the front is directed upward and the upper end is directed forward in the conveying direction are referred to as a front-up (FF) banknote. The banknotes P taken out in a state that the front is directed upward and the lower end is directed forward in the conveying direction are referred to as a front-down (FR) banknote (first banknotes). The banknotes P taken out in a state that the back is directed upward and the upper end is directed forward in the conveying direction are referred to as a back-up (BF) banknote. The banknotes P taken out in a state that the back is directed upward and the lower end is directed forward in the conveying direction are referred to as a back-down (BR) banknote. Namely, the banknotes P conveyed through the detector 30 are conveyed in any of the four kinds of conveying postures.

In FIG. 1 again, on the conveying path 12 extended on the downstream side of the detector 30, a plurality of gates G1 to G9 for selectively switching the conveying direction of the banknotes P on the basis of detection results by the detector 30 are installed.

Banknotes that the process at the subsequent stage is judged as impossible by the detector 30 such as banknotes judged as two banknotes taken out at the same time, banknotes judged as greatly skewed beyond a predetermined level, or banknotes (not limited to banknotes) such as damaged banknotes or false banknotes not judged as a normal banknote capable of re-circulation are conveyed in the right direction in the drawing via the gate G1 and ejected into a rejection box 32. To the rejection box 32, access from the outside of the frame 2 of the paper-like material processing apparatus 1 is possible.

On the other hand, the banknotes P judged as normal banknotes capable of processing by the detector 30 are conveyed in the left direction in the drawing toward the gate G2 via the gate G1. The banknotes P passing through the gate G1, as mentioned above, are in the disordered state of "front and back" and "top and bottom". When the banknotes P in the disordered state of "front and back" and "top and bottom" like this selectively pass through a front/back reversing mechanism 34 which will be described later, the front and back are properly arranged and the banknotes are classified and stacked for each money kind. In this embodiment, all the banknotes P are basically stacked with the front positioned up.

The conveying path 12 on the downstream side of the gate G2 is branched in two directions. When the gate G2 is selectively switched between the two positions, the conveying direction of the banknotes P can be selectively switched to the two directions.

On one of the conveying paths branched on the downstream side of the gate G2, the front/back reversing mechanism 34 (front/back reversing portion) for reversing the front and back of the banknotes P is installed. The conveying path passing through the front/back reversing mechanism 34 forms a twist conveying path 34*a* rotated at an angle of 180° round the central axis from the inlet to the outlet thereof. And, 2 sets of conveying belts 33 and 35 are installed in a twist state so as to face each other along the twist conveying path 34*a*. Further, the other of the conveying paths branched on the downstream side of the gate G2 is a conveying path 36 only for passing the banknotes P.

Figure 3:
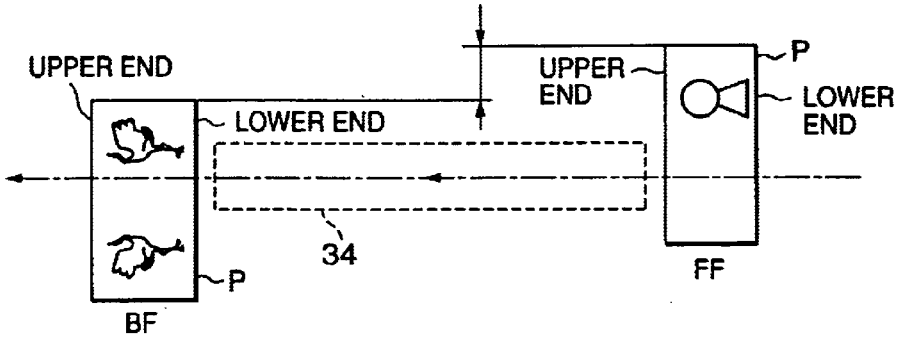
FIG. 3 is a plan view for explaining the front/back reversing operation of a banknote by the front/back reversing mechanism incorporated in the banknote processing apparatus.

The banknotes P which are distributed via the gate G2 and conveyed through the twist conveying path 34*a* of the front/back reversing mechanism 34 are reversed with front and back, for example, as shown in FIG. 3. Here, a state that a banknote (FF banknote) conveyed into the front/back reversing mechanism 34 in a state that the front is positioned up and the upper end is positioned at the top is reversed with front and back and conveyed from the front/back reversing mechanism 34 as a BF banknote with the back positioned up is shown.

The banknotes P passing through the front/back reversing mechanism 34 and reversed with front and back like this and the banknotes P passing through the conveying path 36 without passing through the front/back reversing mechanism 34 are all sent to the gate G3 via a joining portion 38. At this time, the length of the conveying path 36 is set so that the processing time of the banknotes P from passing through the gate G2 to reaching the joining portion 38 via the front/back reversing mechanism 34 is made equal to the conveying time of the banknotes P from passing through the conveying path 36 to reaching the joining portion 38. By doing this, the banknotes P conveyed through the front/back reversing mechanism 34 and the banknotes P passing through the conveying path 36 pass through the joining portion 38 at the same timing. Therefore, all banknotes P can be processed under the same condition regardless of the processing configuration.

The conveying path 12 on the downstream side of the gate G3 is branched in two directions. When the gate G3 is selectively switched between the two positions, the conveying direction of the banknotes P can be selectively switched to the two directions.

One of the conveying paths branched in the right direction in the drawing on the downstream side of the gate G3 forms a horizontal conveying path 40 extended almost in the horizontal direction above a plurality of stackers 41 to 46 (third stacker). On the horizontal conveying path 40, five gates G5 to G9 for distributing and stacking the banknotes P to be conveyed to any one of the six stackers 41 to 46 are installed.

The banknotes P selectively distributed by the gate G5 positioned on the uppermost stream side of the horizontal conveying path 40 are stacked in the stacker 41. The banknotes P selectively distributed by the gate G6 are stacked in the stacker 42. The banknotes P selectively distributed by the gate G7 are stacked in the stacker 43. The banknotes P selectively distributed by the gate G8 are stacked in the stacker 44. The banknotes P selectively distributed by the gate G9 are stacked in the stacker 45 or 46.

On the other of the conveying paths branched in the left direction in the drawing on the downstream side of the gate G3, the gate G4 (distribution portion) for selectively switching the conveying direction of the banknotes P to two directions is arranged. At the two positions branched by the gate G4, stackers 51 and 52 of a banding device 50 are installed respectively. The banding device 50 stacks, for example, 100 banknotes P and bands them by winding a paper strip round them. By doing this, a bundle of the banknotes P is formed.

To the stackers 51 and 52 of the banding device 50, the banknotes P of a specific money kind assigned banding with a paper strip are sent (stacked) according to a rule that will be described later. On the other hand, the banknotes P other than a specific money kind are stacked in any of the aforementioned stackers 41 to 46.

Figure 4:
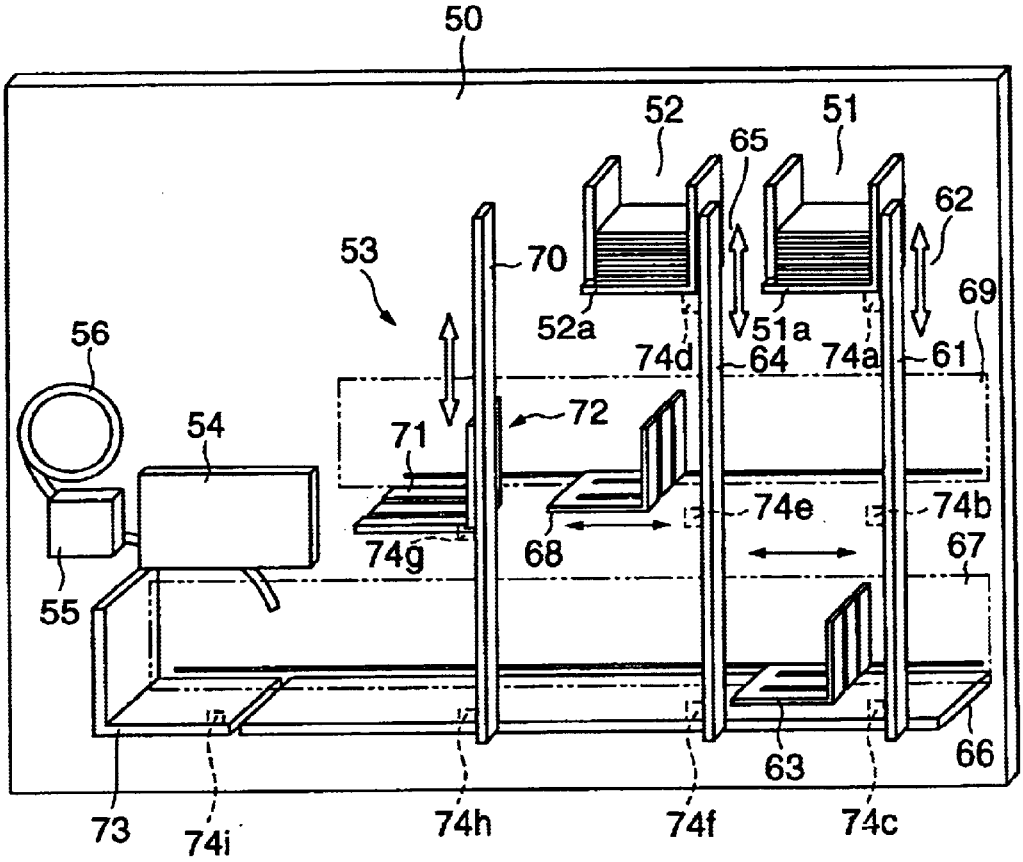
FIG. 4 is a perspective view for explaining the internal constitution of the banding device.

The banding device 50, as shown in FIGS. 1 and 4, is composed of the stackers 51 and 52, a supply portion 53, a single banding portion (banding mechanism) 54, a printer 55, and a strip supply portion 56.

The stackers 51 and 52 stack the banknotes P respectively sent via the gates G3 and G4.

The banding portion 54 is a single banding mechanism for banding 100 banknotes P stacked in the stacker 51 or 52, which are supplied by the supply portion 53, with a paper strip.

The supply portion 53 supplies the 100 banknotes P stacked in the stacker 51 or 52 to the banding portion 54.

The printer 55 prints characters on paper strips used by the banding portion 54.

The strip supply portion 56 supplies paper strips used by the banding portion 54.

In the stackers 51 and 52, the banknotes P that the "front and back" and "top and bottom" are properly arranged are stacked. The stacker 51 functions as a first stacker of the present invention and the stacker 52 functions as a second stacker of the present invention.

The banknotes P stacked in either of the stackers 51 and 52 via the gate G4 are sent to the banding portion 54 by the supply portion 53 and banded with paper strips supplied from the strip supply portion 56. A bundle of the banknotes P banded for each predetermined number of banknotes is conveyed outside the apparatus via a conveyor not shown in the drawing.

The banding portion 54 receives the banknotes P of a predetermined number stacked in the stackers 51 and 52, winds a paper strip P along the transverse direction thereof at the biased position on one side in the longitudinal direction thereof (the rear side of the banknote processing apparatus 1 in this embodiment), bands the banknotes P of a predetermined number, and forms a bundle.

The constitution of the supply portion 53 of the banding device 50 will be explained in detail by referring to FIG. 4.

Namely, a backup 51*a* of the stacker 51 is a base for stacking the banknotes P to be supplied to the stacker 51. The backup 51*a* is connected to a moving mechanism 62 moving up and down along a guide plate 61 installed upright on a bottom 66.

Further, a backup 52*a* of the stacker 52 is a base for stacking the banknotes P to be supplied to the stacker 52. The backup 52*a* is connected to a moving mechanism 65 moving up and down along a guide plate 64 installed upright on the bottom 66.

Further, a moving mechanism 72 moving up and down along a guide plate 70 installed upright on the bottom 66 is installed. To the moving mechanism 72, a delivery tray 71 as a delivery portion is fixed. The delivery tray 71 moves up and down along the guide plate 70 by the moving mechanism 72.

On the bottom plate 66, a carrier 63 moving in the left direction or the right direction of the drawing by a moving mechanism 67 is installed.

When the carrier 63 is positioned at the lower part of the stacker 51 and the backup 51*a* loading the stacked banknotes P moves down and is positioned below the carrier 63, the stacked banknotes P are transferred to the carrier 63. The bottom of the carrier 63 and the bottom of the backup 51*a* are comb-teeth-shaped and respectively have a nested constitution.

When the carrier 63 is positioned at the lower part of the stacker 52 and the backup 52*a* loading the stacked banknotes P moves down and is positioned below the carrier 63, the stacked banknotes P are transferred to the carrier 63. The bottom of the carrier 63 and the bottom of the backup 52*a* are comb-teeth-shaped and respectively have a nested constitution.

When the carrier 63 is positioned at the lower part of the delivery tray 71 and the delivery tray 71 loading the stacked banknotes P moves down and is positioned below the carrier 63, the stacked banknotes P are transferred to the carrier 63. The bottom of the carrier 63 and the bottom of the delivery tray 71 are comb-teeth-shaped and respectively have a nested constitution.

The carrier 63 moves the stacked banknotes P transferred from the backup 51*a*, the stacked banknotes P transferred from the backup 52*a*, and the stacked banknotes P transferred from the delivery tray 71 to the banding position by the banding mechanism 54.

On the bottom plate 66 and above the moving position of the carrier 63, a temporarily holding carrier (temporarily holding portion) 68 moving in the left direction or right direction of the drawing by a moving mechanism 69 is installed.

When the carrier 68 is positioned at the lower part of the stacker 51 and the backup 51*a* loading the stacked banknotes P moves down and is positioned below the carrier 68, the stacked banknotes P are transferred to the carrier 68. The bottom of the carrier 68 and the bottom of the backup 51*a* are comb-teeth-shaped and respectively have a nested constitution.

When the carrier 68 is positioned at the lower part of the stacker 52 and the backup 52*a* loading the stacked banknotes P moves down and is positioned below the carrier 68, the stacked banknotes P are transferred to the carrier 68. The bottom of the carrier 68 and the bottom of the backup 52*a* are comb-teeth-shaped and respectively have a nested constitution.

When the carrier 68 in a state of loading the stacked banknotes P is positioned at the passing point of the delivery tray 71, and the delivery tray 71 is positioned at the lower point where the carrier 68 and the delivery tray 71 do not collide each other, and the delivery tray 71 moves up and is positioned above the carrier 68, the stacked banknotes are transferred from the carrier 68 to the delivery tray 71. The bottom of the carrier 68 and the bottom of the delivery tray 71 are comb-teeth-shaped and respectively have a nested constitution.

On the lower part of the banding mechanism 54, a banding tray 73 is installed. Further, on the main moving positions of the trays, carriers, and backups, detectors 74*a*, - - - , and 74*i* for position detection are respectively installed.

Figure 6:
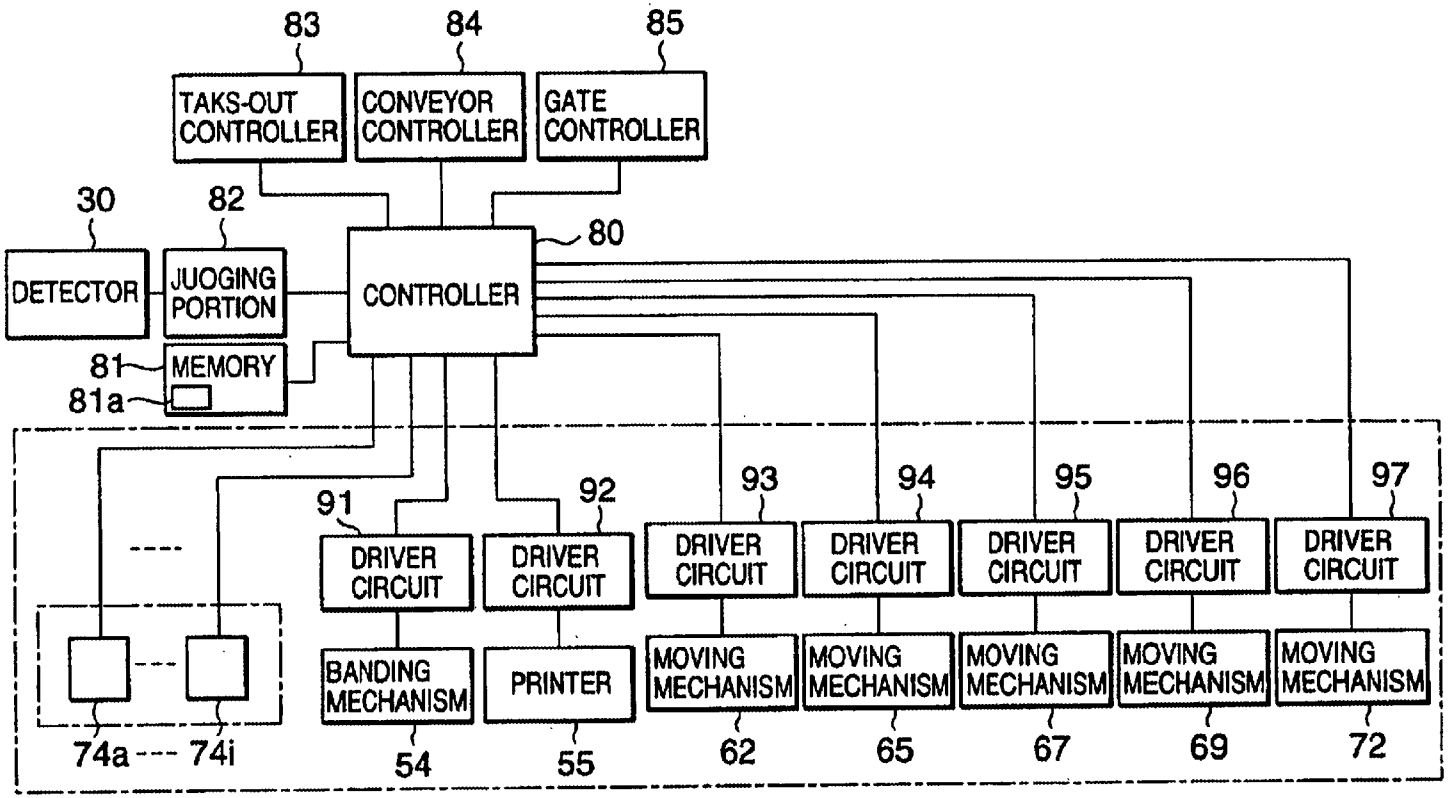
FIG. 6 is a block diagram of the control system for controlling the operation of the banknote processing apparatus.

FIG. 6 shows a block diagram of the control system for controlling the aforementioned operation of the banknote processing apparatus 1.

The banknote processing apparatus 1 is composed of a controller 80, a memory 81, a judging portion 82, a take-out controller 83, a conveyor controller 84, a gate controller 85, and drive circuits 91 to 97.

The controller 80 controls the overall operation of the apparatus according to a preset operation program. The controller 80 judges the main moving positions of the respective trays, carriers, and backups by detection signals from the detectors 74*a* to 74*i*.

The memory 81 is used to store the operation program and data and a counter table 81*a* for counting the number of banknotes stacked in each of the stackers 51 and 52 is installed in the memory 81.

The judging portion 82 judges whether the concerned banknotes P can be re-circulated or not, judges whether the concerned banknotes P are banknotes of a specific money kind designated for banding, and judges the "front and back" and "top and bottom" of the banknotes P on the basis of the detection results of the detector 30 and outputs the respective judgment results to the controller 80.

The take-out controller 83 rotates the take-out rollers 10 under control of the controller 80.

The conveyor controller 84 rotates the conveying rollers in the conveying path 12 under control of the controller 80.

The gate controller 85 drives the gates G1 to G9 under control of the controller 80.

The drive circuit 91 drives the banding mechanism 54 under control of the controller 80.

The drive circuit 92 drives the printer 55 under control of the controller 80.

The drive circuit 93 drives the moving mechanism 62 under control of the controller 80, thereby moves the backup 51*a* of the stacker 51 up and down.

The drive circuit 94 drives the moving mechanism 65, thereby moves the backup 52*a* of the stacker 52 up and down.

The drive circuit 95 drives the moving mechanism 67 under control of the controller 80, thereby moves the carrier 63.

The drive circuit 96 drives the moving mechanism 69 under control of the controller 80, thereby moves the carrier 68.

The drive circuit 97 drives the moving mechanism 72 under control of the controller 80, thereby moves the delivery tray 71.

Figure 7:
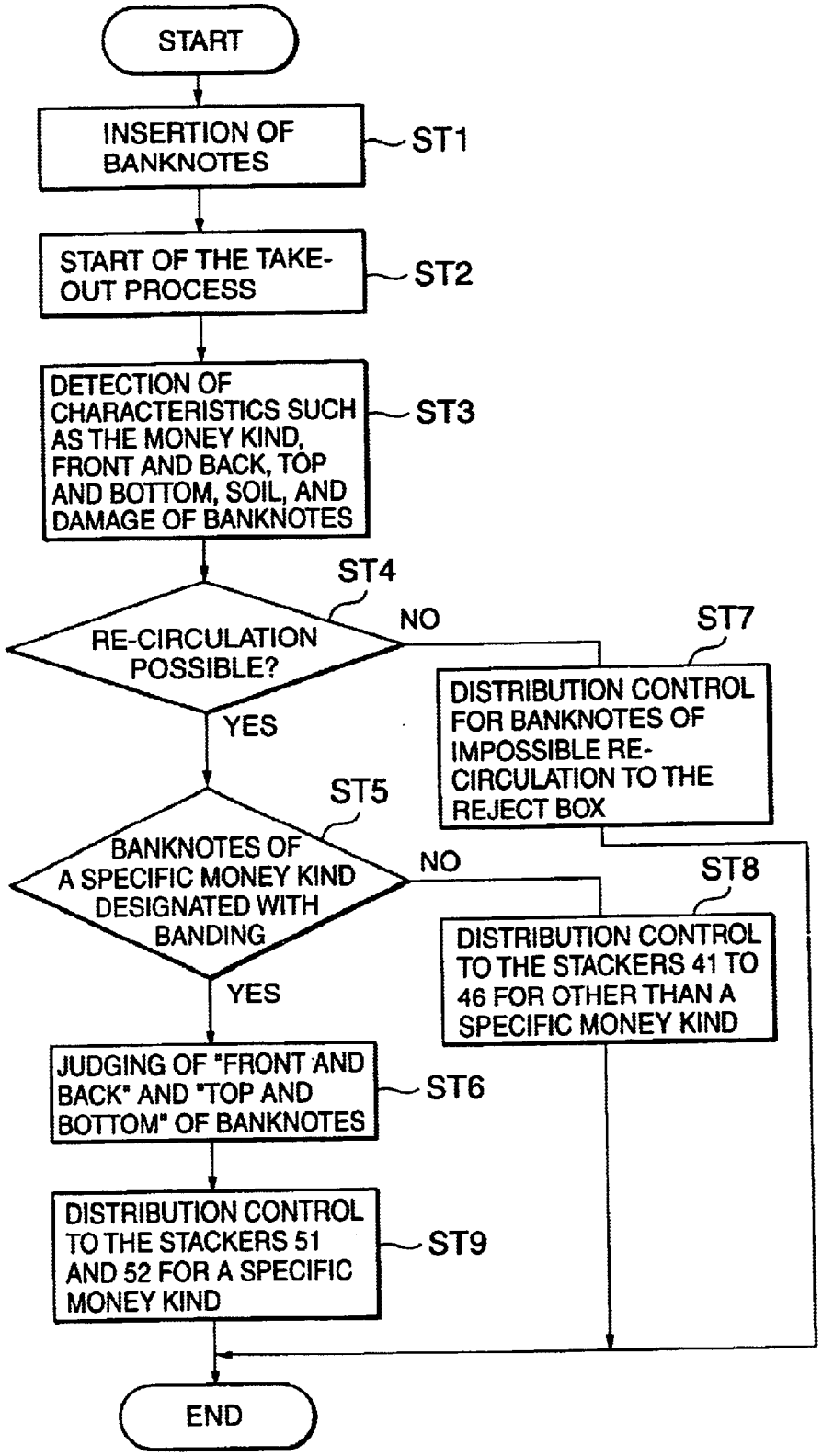
FIG. 7 is a flow chart for explaining the banknote distribution process by the banknote processing apparatus.

Next, the banknote distribution process by the banknote processing apparatus structured as mentioned above will be explained by referring to the flow chart shown in FIG. 7.

Firstly, in a state that that a plurality of money kinds coexist and the "front and back" and "top and bottom" are not properly arranged, a plurality of banknotes P are inserted together into the insert port 4 (ST1). And, start is instructed by an operation panel not shown in the drawing. By this instruction, the controller 80 controls the take-out controller 83 and rotates the take-out rollers 10 (ST2). By rotation of the take-out rollers 10, the banknotes P at the left end of the insert port 4 are taken out one by one and the banknotes P are conveyed on the conveying path 12 (taking in the banknotes P onto the conveying path 12).

By conveying by the conveying path 12, the banknotes P pass through the detector 30. At the time of passing, the detector 30 detects characteristics such as the money kind, front and back, top and bottom, soil, and damage of the banknotes P (ST3) and outputs the detection results to the judging portion 82.

The judging portion 82 judges whether the concerned banknotes P can be re-circulated or not (ST4), judges whether the concerned banknotes P are banknotes of a specific money kind designated for banding (ST5), and judges the "front and back" and "top and bottom" of the banknotes P (ST6) on the basis of the detection results of the detector 30 and outputs the respective judgment results to the controller 80.

The controller 80 executes distribution control of the banknotes P on the basis of the respective judgment results (ST7 to ST9). Namely, the controller 80 executes distribution control to the rejection box 32 for banknotes P incapable of re-circulation (ST7), executes distribution control to the stackers 41 to 46 for banknotes P other than a specific money kind (ST8), and executes distribution control to the stackers 51 and 52 for banknotes P of a specific money kind (ST9).

As a result of judgment at Step 4, when the concerned banknotes P are judged as incapable of re-circulation, the gate G1 is switched so as to direct the conveying path of the concerned banknotes P toward the rejection box 32 and the concerned banknotes P are ejected into the rejection box 32.

As a result of judgment at Step 5, when the banknotes P are judged as not banknotes of a specific money kind, the gate G1 is switched toward the gate G2. At this time, when it is judged at Step 3 that the concerned banknotes P are conveyed with the front positioned up, the gate G2 is switched toward the conveying path 36, and when it is judged that the concerned banknotes P are conveyed with the back positioned up, the gate G2 is switched toward the front/back reversing mechanism 34, and the front and back of the banknotes are reversed. And, the gate G3 is switched toward the horizontal conveying path 40 and the banknotes passing through the joining portion 38 in a state that the front and back are properly arranged (the front is positioned up in this embodiment) are selectively stacked in the stackers 41 to 46 according to the money kind thereof. At this time, the gates G5 to G9 are switched according to the money kind of the concerned banknotes P judged at Step 3.

Figure 8:
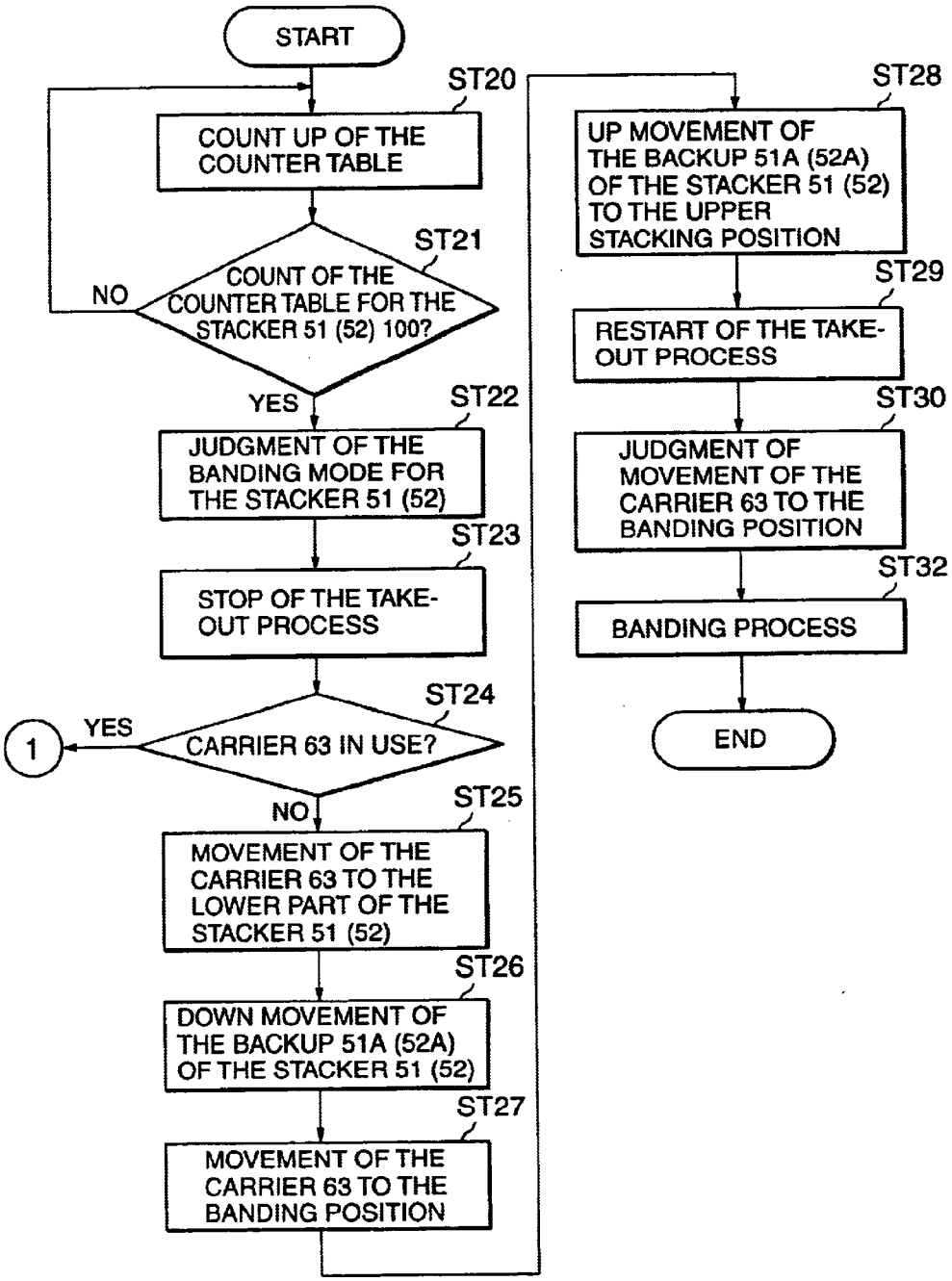
FIG. 8 is a flow chart for explaining the banding process in correspondence with distribution control for two stackers.
Figure 9:
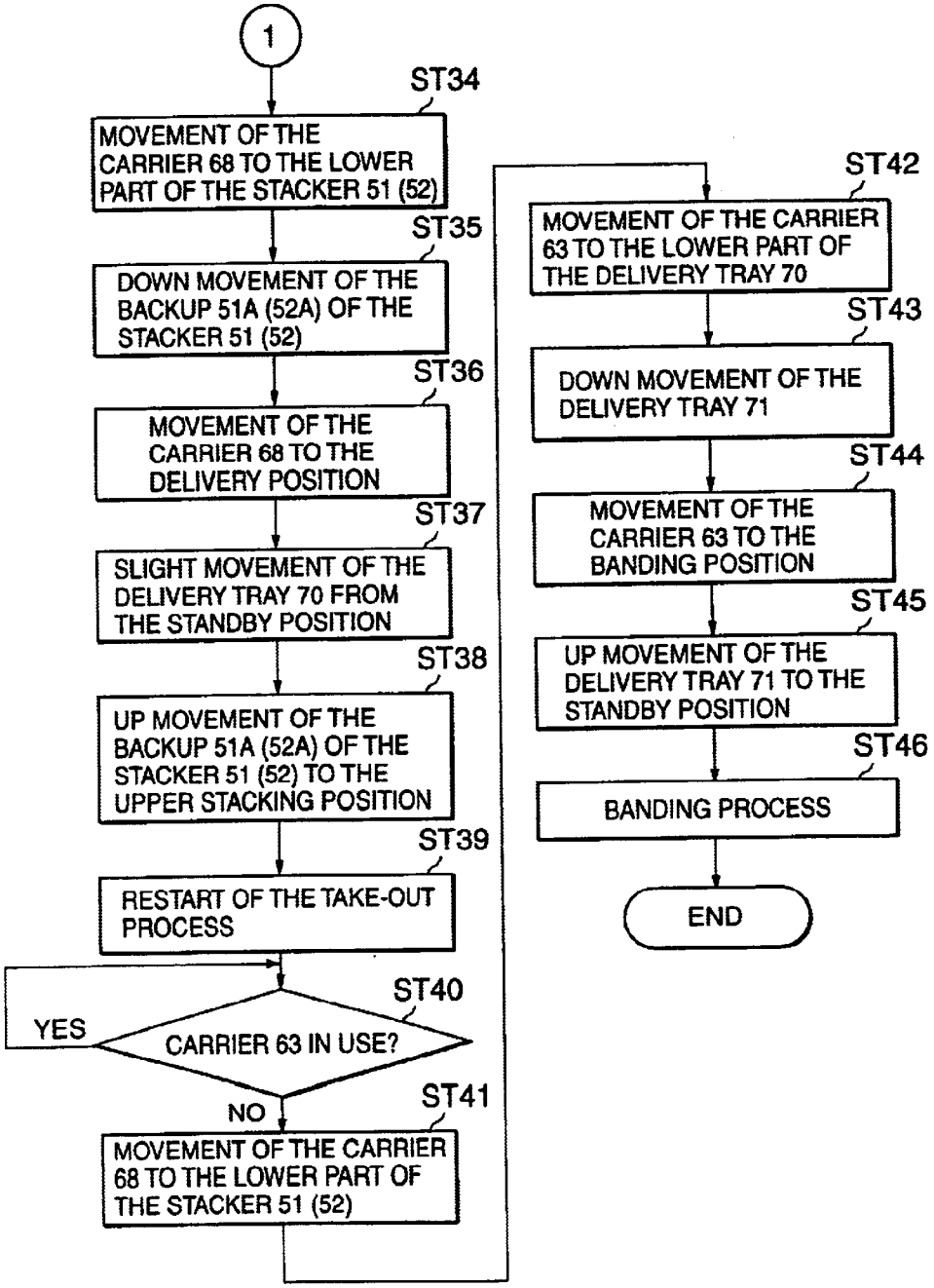
FIG. 9 is a flow chart for explaining the banding process in correspondence with distribution control for two stackers.

Next, the banding process in correspondence with the distribution control to the stackers 51 and 52 will be explained by referring to the flow charts shown in FIGS. 8 and 9.

Firstly, the process when 100 banknotes P are stacked in the stacker 51 will be explained hereunder.

Namely, the controller 80 judges the banknotes P to be stacked in the stacker 51 on the basis of the judgment results respectively of the "front and back" and "top and bottom" of the banknotes P of a specific kind. At that time, the counter table 81*a* of the memory 81 corresponding to the stacker 51 is counted up (ST20).

At this time, when the count of the counter table 81*a* for the stacker 51 reaches 100 banknotes (ST21), the controller 80 judges the banding mode for the stacker 51 (ST22). Further, the controller 80 controls the take-out controller 83 and stops the rotation of the take-out rollers 10 (ST23). And, when the banknotes P are stacked in the stacker 51, the controller 80 judges whether the carrier is in use or not at present (ST24).

When the carrier 63 is not in use as a result of judgment, the controller 80 controls the moving mechanism 67 and moves the carrier 63 to the lower part of the stacker 51 (ST25). Then, the controller 80 controls the moving mechanism 62 and moves down the backup 51*a* of the stacker 51 (ST26). When the backup 51*a* moves down as far as the bottom thereof, the stacked banknotes P on the backup 51*a* of the stacker 51 are transferred onto the carrier 63. After transfer, the controller 80 controls the moving mechanism 67 and moves the carrier 63 to the banding position (ST27). Then, the controller 80 controls the moving mechanism 62 and moves up the backup 51*a* of the stacker 51 to the upper stacking position (ST28). When the backup 51*a* reaches the stacking position of the stacker 51, the controller 80 judges restart of take-out, controls the take-out controller 83, and restarts the rotation of the take-out rollers 10 (ST29). By rotation of the take-out rollers 10, the take-out of the banknotes P from the insert port 4 is restarted.

Further, when the controller 80 judges movement of the carrier 63 to the banding position (ST30), the controller 80 controls the banding mechanism 54, thereby bands the stacked banknotes P on the carrier 63 by the banding mechanism 54 (ST32). The stacked banknotes P banded are transferred onto the conveyor by a pressing mechanism not shown in the drawing, thereby conveyed out of the apparatus by the conveyor.

When the carrier 63 is in use as a result of Step 24, the controller 80 controls the moving mechanism 69 and moves the temporarily holding carrier (temporarily holding portion) 68 to the lower part of the stacker 51 (ST34). Then, the controller 80 controls the moving mechanism 62 and moves down the backup 51*a* of the stacker 51 (ST35). When the backup carrier 51*a* moves down as far as the middle part thereof, the stacked banknotes P on the backup 51*a* of the stacker 51 are transferred onto the carrier 68. After transfer, the controller 80 controls the moving mechanism 69 and moves the carrier 68 to the delivery position (ST36). Then, when the carrier 68 moves to the delivery position, the controller 80 controls the moving mechanism 72 and when the delivery tray 71 moves up slightly from the standby position, the stacked banknotes P on the carrier 68 are transferred onto the delivery tray 71 (ST37).

After the carrier 68 moves to the delivery position, the controller 80 moves up the backup 51*a* of the stacker 51 to the upper stacking position (ST38). When the backup 51*a* reaches the stacking position of the stacker 51, the controller 80 judges restart of take-out, controls the take-out controller 83, and restarts the rotation of the take-out rollers 10 (ST39). By rotation of the take-out rollers 10, the take-out of the banknotes P from the insert port 4 is restarted.

When the controller 80 judges thereafter that the carrier 63 is not in use (usable) (ST40), the controller 80 controls the moving mechanism 69 and moves the carrier 68 to the lower part of the stacker 52 (ST41). Then, when the carrier 68 moves to the lower part of the stacker 52, the controller 80 controls the moving mechanism 67 and moves the carrier 68 to the lower part of the delivery tray 71 (ST42). Then, the controller 80 controls the moving mechanism 72 and moves down the delivery tray 71 (ST43). When the delivery tray 71 moves down as far as the bottom thereof, the stacked banknotes P on the delivery tray 71 are transferred onto the carrier 63. After transfer, the controller 80 controls the moving mechanism 67 and moves the carrier 63 to the banding position (ST44). Then, the controller 80 controls the moving mechanism 72 and moves up the delivery tray 71 to the standby position (ST45).

Thereafter, the controller 80 controls the banding mechanism 54, thus the stacked banknotes P on the carrier 63 are banded (ST46). The stacked banknotes P banded are transferred onto the conveyor by a pressing mechanism not shown in the drawing, thereby conveyed out of the apparatus by the conveyor.

Next, the process when 100 banknotes P are stacked in the stacker 52 will be explained. The reference numerals in the steps shown in FIGS. 8 and 9 are enclosed by parentheses.

Namely, the controller 80 judges the banknotes P to be stacked in the stacker 52 on the basis of the respective judgment results of "front and back" and "top and bottom" of the banknotes P of a specific money kind. On the basis of this judgment, the counter table 81*a* of the memory 81 corresponding to the stacker 52 is counted up (ST20).

At this time, when the count of the counter table 82*a* for the stacker 51 reaches 100 banknotes (ST21), the controller 80 judges the banding mode for the stacker 52 (ST22). Further, the controller 80 controls the take-out controller 83 and stops the rotation of the take-out rollers 10 (ST23). And, when the concerned banknotes P are stacked in the stacker 52, the controller 80 judges whether the carrier is in use or not at present (ST24).

When the carrier 63 is not in use as a result of judgment, the controller 80 controls the moving mechanism 67 and moves the carrier 63 to the lower part of the stacker 52 (ST25). Then, the controller 80 controls the moving mechanism 65 and moves down the backup 52*a* of the stacker 52 (ST26). When the backup 52*a* moves down as far as the bottom thereof, the stacked banknotes P on the backup 52*a* of the stacker 52 are transferred onto the carrier 63.

After transfer, the controller 80 controls the moving mechanism 67 and moves the carrier 63 to the banding position (ST27). Then, the controller 80 controls the moving mechanism 62 and moves up the backup 52*a* of the stacker 52 to the upper stacking position (ST28). When the backup 52*a* reaches the stacking position of the stacker 52, the controller 80 judges restart of take-out, controls the take-out controller 83, and restarts the rotation of the take-out rollers 10 (ST29). By rotation of the take-out rollers 10, the take-out of the banknotes P from the insert port 4 is restarted.

Further, when the controller 80 judges movement of the carrier 63 to the banding position (ST30), the controller 80 controls the banding mechanism 54, thereby bands the stacked banknotes P on the carrier 63 by the banding mechanism 54 (ST32). The stacked banknotes P banded are transferred onto the conveyor by a pressing mechanism not shown in the drawing, thereby conveyed out of the apparatus by the conveyor.

When the carrier 63 is in use as a result of Step 24, the controller 80 controls the moving mechanism 69 and moves the temporarily holding carrier (temporarily holding portion) 68 to the lower part of the stacker 52 (ST34). Then, the controller 80 controls the moving mechanism 65 and moves down the backup 52*a* of the stacker 52 (ST35). When the backup carrier 52*a* moves down as far as the middle part thereof, the stacked banknotes P on the backup 52*a* of the stacker 52 are transferred onto the carrier 68. After transfer, the controller 80 controls the moving mechanism 69 and moves the carrier 68 to the delivery position (ST36). Then, when the carrier 68 moves to the delivery position, the controller 80 controls the moving mechanism 72 and when the delivery tray 71 moves up slightly from the standby position, the stacked banknotes P on the carrier 68 are transferred onto the delivery tray 71 (ST37).

After the carrier 68 moves to the delivery position, the controller 80 moves up the backup 52*a* of the stacker 52 to the upper stacking position (ST38). When the backup 52*a* reaches the stacking position of the stacker 52, the controller 80 judges restart of take-out, controls the take-out controller 83, and restarts the rotation of the take-out rollers 10 (ST39). By rotation of the take-out rollers 10, the take-out of the banknotes P from the insert port 4 is restarted.

When the controller 80 judges thereafter that the carrier 63 is not in use (usable) (ST40), the controller 80 controls the moving mechanism 69 and moves the carrier 68 to the lower part of the stacker 52 (ST41). Then, when the carrier 68 moves to the lower part of the stacker 52, the controller 80 controls the moving mechanism 67 and moves the carrier 68 to the lower part of the delivery tray 71 (ST42). Then, the controller 80 controls the moving mechanism 72 and moves down the delivery tray 71 (ST43). When the delivery tray 71 moves down as far as the bottom thereof, the stacked banknotes P on the delivery tray 71 are transferred onto the carrier 63. After transfer, the controller 80 controls the moving mechanism 67 and moves the carrier 63 to the banding position (ST44). Then, the controller 80 controls the moving mechanism 72 and moves up the delivery tray 71 to the standby position (ST45).

Further, when the controller 80 judges movement of the carrier 63 to the banding position, the controller 80 controls the banding mechanism 54, thus the stacked banknotes P on the carrier 63 are banded (ST46). The stacked banknotes P banded are transferred onto the conveyor by a pressing mechanism not shown in the drawing, thereby conveyed out of the apparatus by the conveyor.

Figure 5:
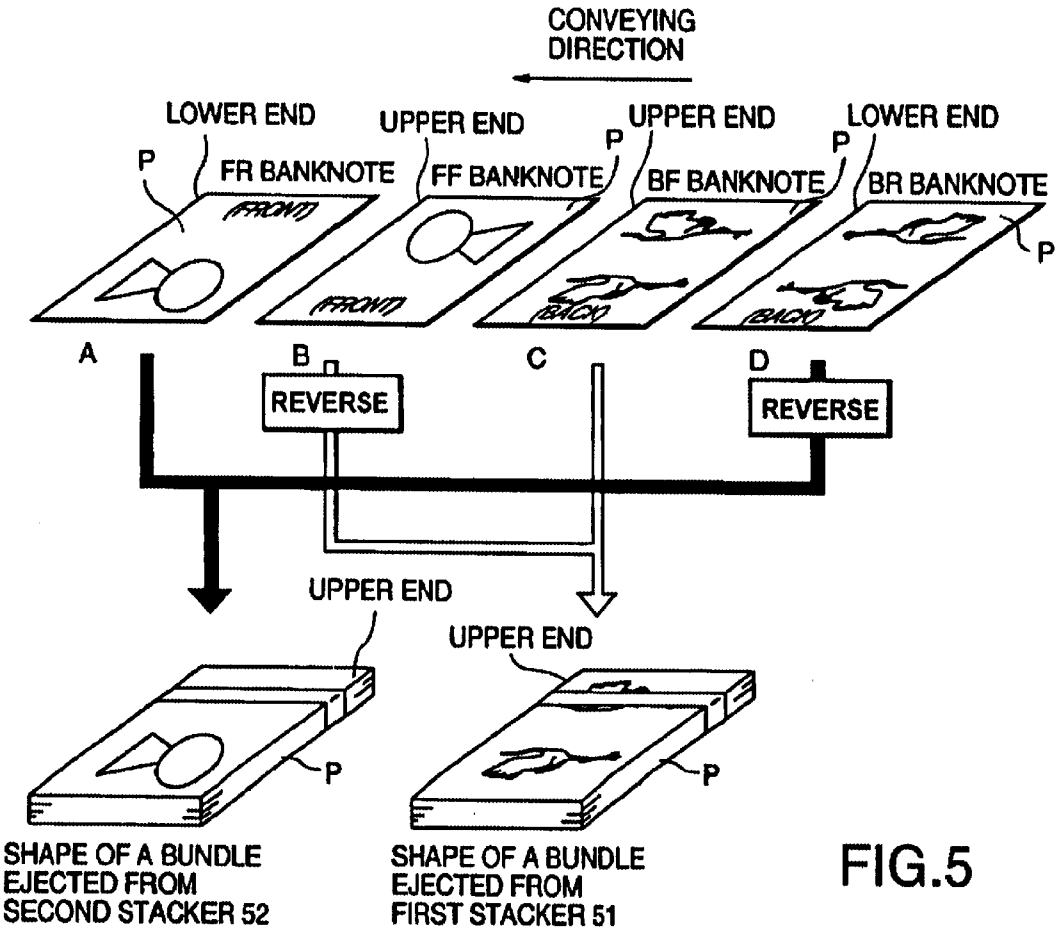
FIG. 5 is a drawing for explaining the distribution process into two stackers on the basis of decision results of the judging portion.
Figure 10:
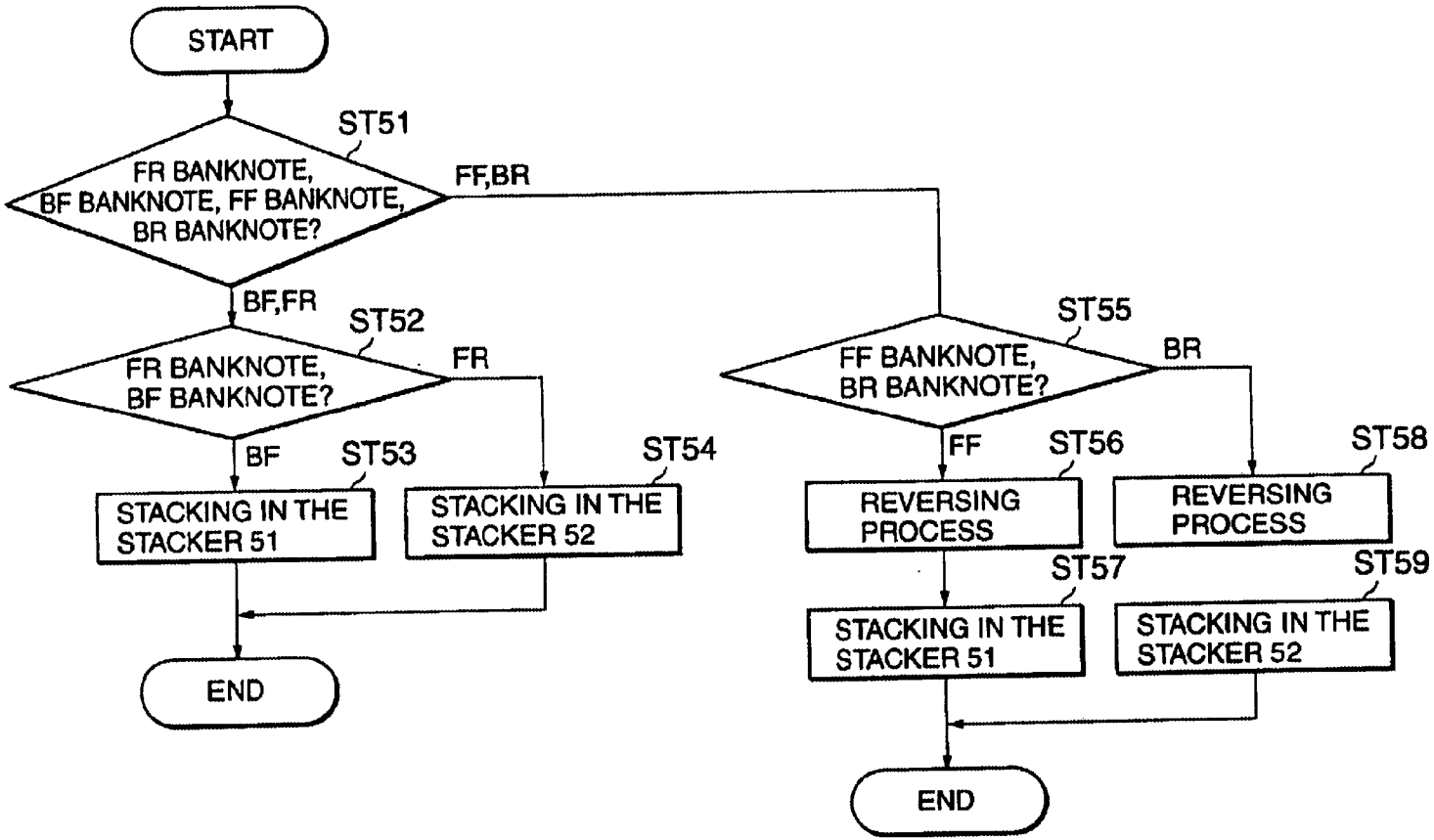
FIG. 10 is a flow chart for explaining the distribution process into two stackers on the basis of decision results of the judging portion.

Next, the distribution process into the stackers 51 and 52 on the basis of the judgment results of the judging portion 82 will be explained by referring to the flow chart shown in FIG. 10 and the stacking state in the stackers 51 and 52 in the conveying direction of banknotes shown in FIG. 5.

Namely, on the basis of the respective judgment results of "front and back" and "top and bottom" of the banknotes P of a specific money kind, the controller 80 judges an FR banknote (A shown in FIG. 5) that the concerned banknote P is conveyed in a state that the lower end thereof is positioned at the top and the front thereof is positioned up, an FF banknote (B shown in FIG. 5) that the concerned banknote P is conveyed in a state that the upper end thereof is positioned at the top and the front thereof is positioned up, a BF banknote (C shown in FIG. 5) that the concerned banknote P is conveyed in a state that the upper end thereof is positioned at the top and the back thereof is positioned up, and a BR banknote (D shown in FIG. 5) that the concerned banknote P is conveyed in a state that the lower end thereof is positioned at the top and the back thereof is positioned up (ST51, ST52, and ST55).

On the basis of the judgment results, the banknotes P judged as an FR banknote pass through the detector 30, then are conveyed to the stacker 52 sequentially via the gates G1 and G2, the conveying path 36, and the gates G3 and G4, thereby stacked in the stacker 52 (ST54).

Further, the banknotes P judged as an FF banknote pass through the detector 30, then are conveyed and reversed by the front/back reversing mechanism 34 sequentially via the gates G1 and G2 (the same direction as that of the BF banknote) (ST56), then conveyed to the stacker 51 sequentially via the gates G3 and G4, thereby stacked in the stacker 51 (ST57).

Further, the banknotes P judged as a BF banknote pass through the detector 30, then are conveyed to the stacker 51 sequentially via the gates G1 and G2, the conveying path 36, and the gates G3 and G4, thereby stacked in the stacker 51 (ST53).

Further, the banknotes P judged as a BR banknote pass through the detector 30, then are conveyed and reversed by the front/back reversing mechanism 34 sequentially via the gates G1 and G2 (the same direction as that of the FR banknote) (ST58), then conveyed to the stacker 52 sequentially via the gates G3 and G4, thereby stacked in the stacker 52 (ST59).

By doing this, the BF banknotes are stacked in the stacker 51 on the right and the FR banknotes are stacked in the stacker 52 on the left. Namely, in the two stackers 51 and 52, each banknote P is stacked in a state that the "front and back" and "top and bottom" are properly arranged.

Furthermore, BF banknotes of a predetermined number (100) stacked in the stacker 51 are banded with a paper strip by the banding portion 54 and FR banknotes of a predetermined number stacked in the stacker 52 are banded with a paper strip by the banding portion 54. At this time, as shown in FIG. 5, the BF banknotes with the back positioned up are wound with a paper strip at the biased position on the rear side of the apparatus and the FR banknotes with the front positioned up are also wound with a paper strip at the biased position on the rear side of the apparatus. Therefore, after all, the paper strip winding position of each bundle banded by the banding portion 54 is the same.

As a result, when the banknote distribution and banding process by the banknote processing apparatus 1 for collecting banknotes conveyed in the four directions for each predetermined number and winding a paper strip is to be executed, the winding position can be properly arranged using the front/back reversing mechanism by the twist conveying path without using a complicated mechanism such as a switch-back mechanism.

As mentioned above, by the banknote processing apparatus of this embodiment, the apparatus constitution that the paper strip banding position by the banding portion is set on the rear side of the apparatus is kept unchanged and the "front and back" and "top and bottom" of every banknote P can be properly arranged. Moreover, banknotes with the front thereof positioned up are stacked in the stacker 52 and banknotes with the back thereof positioned up and the top and bottom reversed to those of the stacker 52 are stacked in the stacker 51, thus the winding position of every banknote can be properly arranged.

Further, a constitution requiring banding portions respectively for the two stackers causes an increase in cost, while because a common banding portion, that is, a single banding portion is used, an increase in cost can be suppressed.

Further, when the banding process must be executed almost simultaneously by the two stackers, the stacked banknotes in the stacker where the banding process is not executed are held in the temporarily holding portion. Due to the holding in the temporarily holding stacker, the standby time when the stacking process in one stacker ends and then the stacking process in the other stacker is to be executed requires ten and several seconds, while in this embodiment, the standby time is only 2 or 3 seconds. Therefore, the standby time can be shortened. Therefore, the take-out stop time that the take-out process by the insert port is stopped during standby is shortened and the reduction in the processing efficiency of the banknote processing apparatus can be suppressed.

Namely, when the two stackers reach the specified number almost at the same time, in a case of no temporarily holding portion installed, until the banknotes on the side that the carrier states banding first are completed in winding of paper strips, the stackers cannot return to the position for receiving a banknote from the backup. Therefore, the standby time is made very long.

Namely, the banding and stacking for hastening the take-in start timing is enabled to stack after the stacking backup 51*a* or 52*a* transfers the banknotes to the carrier 63 and is returned to the upper end position again. Further, a fixed time is required for the take-in banknotes to reach the stacker 51 or 52 via the conveying path 12. Therefore, it is not efficient to restart take-in after the backup 51*a* or 52*a* returns.

Therefore, as mentioned above, in the embodiment having an installed temporarily holding portion, as shown in FIG. 1, stackers for banknotes of money kinds other than the one requiring banding are installed and banknotes other than the money kind requiring banding are conveyed to the stackers. Therefore, taken-in banknotes are often not conveyed to banding and stacking continuously and when the banding mechanism is in use, if a specified number of stacked banknotes can be held temporarily, the take-in stop time can be minimized.

As mentioned above, in the apparatus that the backups for respectively loading stacked banknotes in the two stackers are installed and the stacked banknotes on the backups are transferred to a single carrier and conveyed to a single banding mechanism, a temporarily holding mechanism for receiving the stacked banknotes from the backups and a delivery mechanism for transferring the stacked banknotes in the temporarily holding mechanism to the carrier when the carrier is in use are installed and when the carrier becomes usable, the stacked banknotes are transferred to the carrier and banded.

By doing this, when the banding process for banknotes stacked in one stacker and in the other stacker is to be executed almost at the same time, the stop time of the banknote stacking process can be shortened.

Further, two stacking portions are used for a single banding mechanism, so that bundles that the "front and back" and "top and bottom" are properly arranged can be wound.

In the aforementioned embodiment, a case that banknotes of the same money kind are stored in the stackers 51 and 52 is explained. However, this embodiment is not limited to it and can be executed even in a case that banknotes of different money kinds are to be stacked in the stackers 51 and 52. In this case, the "front and back" and "top and bottom" of banknotes can be properly arranged for each money kind and commonly banded by a single banding device. Moreover, when the banding process is to be executed for banknotes of two money kinds almost at the same time, the stop time of the banknote stacking process can be shortened.

In the aforementioned embodiment, to minimize the take-in stop time, a case that a temporarily holding portion is installed is explained. However, the present invention is not limited to it. In FIG. 1, when the corresponding backups reach the position retroactively from the time required to reach the stackable position by the conveying time for the banknotes P to reach the stackers 51 and 52 after taking out from the insert port 4, the take-out process of the banknotes P from the insert port 4 may be restated.

Figure 11:
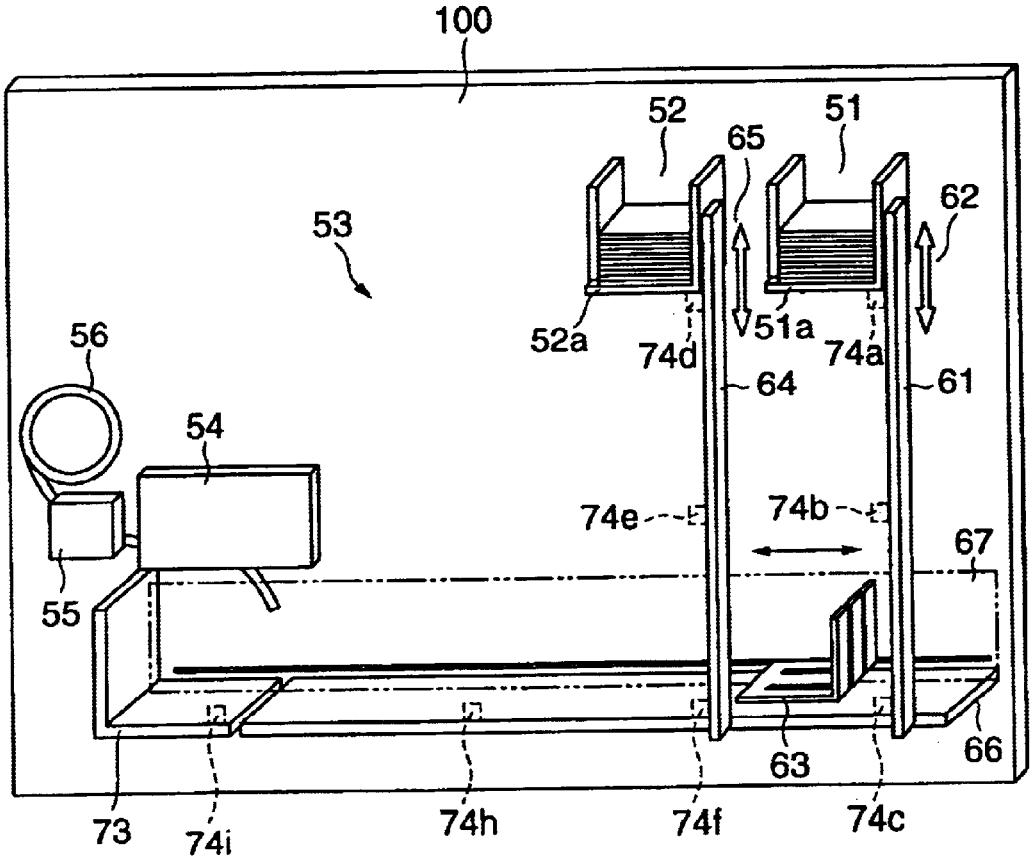
FIG. 11 is a perspective view for explaining the internal constitution of the banding device.

In this case, a banding device 100, as shown in FIG. 11, has a constitution that from the banding device 50 shown in FIG. 4, the carrier 68, the moving mechanism 69, the guide plate 70, the delivery tray 71, the moving mechanism 72, and the detectors 74*g* and 74*h* in the supply portion 53 are removed. Further, the detector 74*b* detects that the backup 51*a* moves up to a predetermined position and the detector 74*e* detects that the backup 52*a* moves up to a predetermined position.

Figure 12:
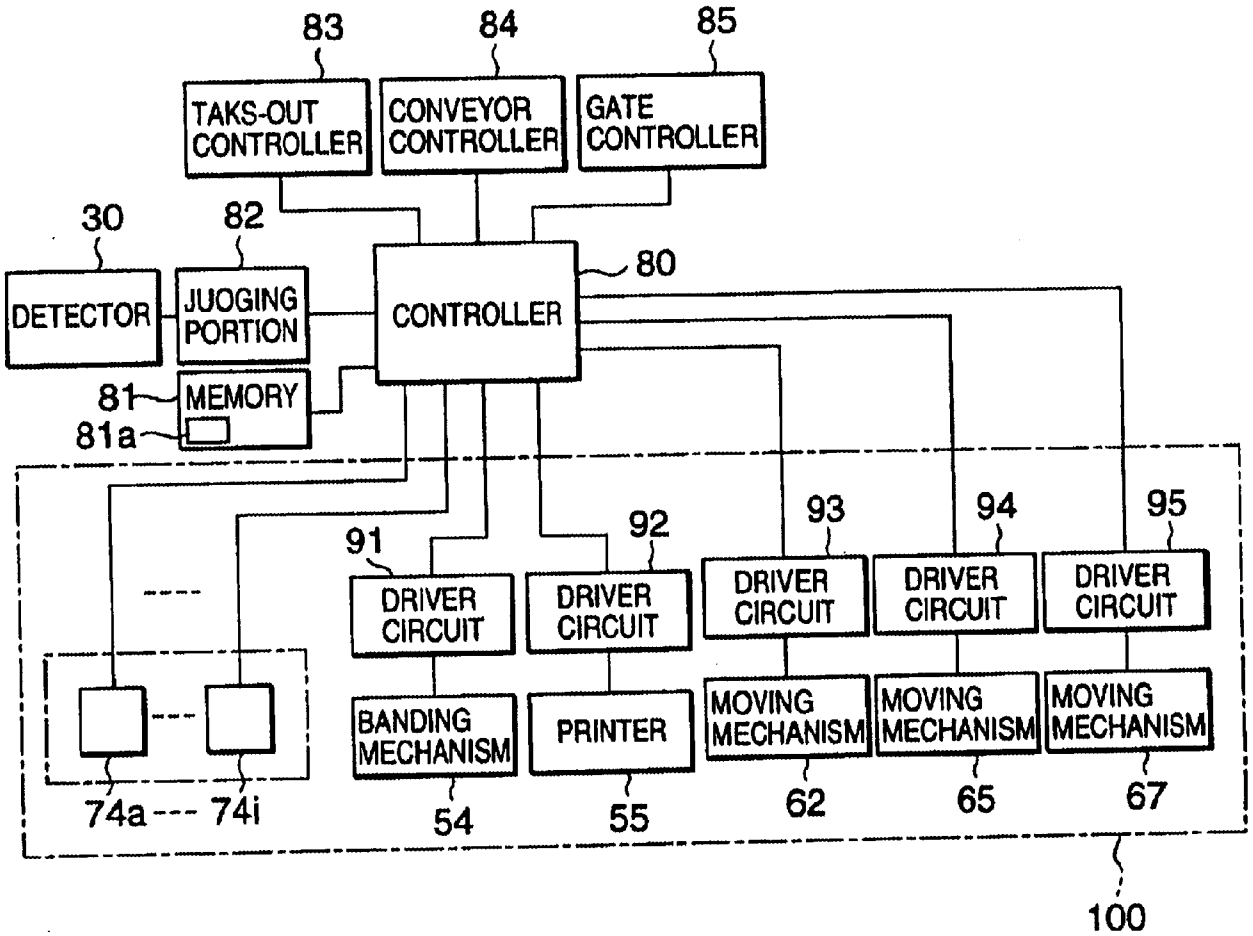
FIG. 12 is a block diagram of the control system for controlling the operation of the banknote processing apparatus.

Further, in correspondence with deletion of the moving mechanisms 69 and 72, the control circuit also has a constitution, as shown in FIG. 12, that the drive circuits 96 and 97 are removed from the constitution shown in FIG. 6.

The time required between detection of the backup 51*a* by the detector 74*b* and movement (moving up) to the stackable position of the stacker 51 and the time that a margin is added to the conveying time between take-out of the banknote P from the insert port 4 and arrival at the stackers 51 and 52 are almost the same.

Figure 13:
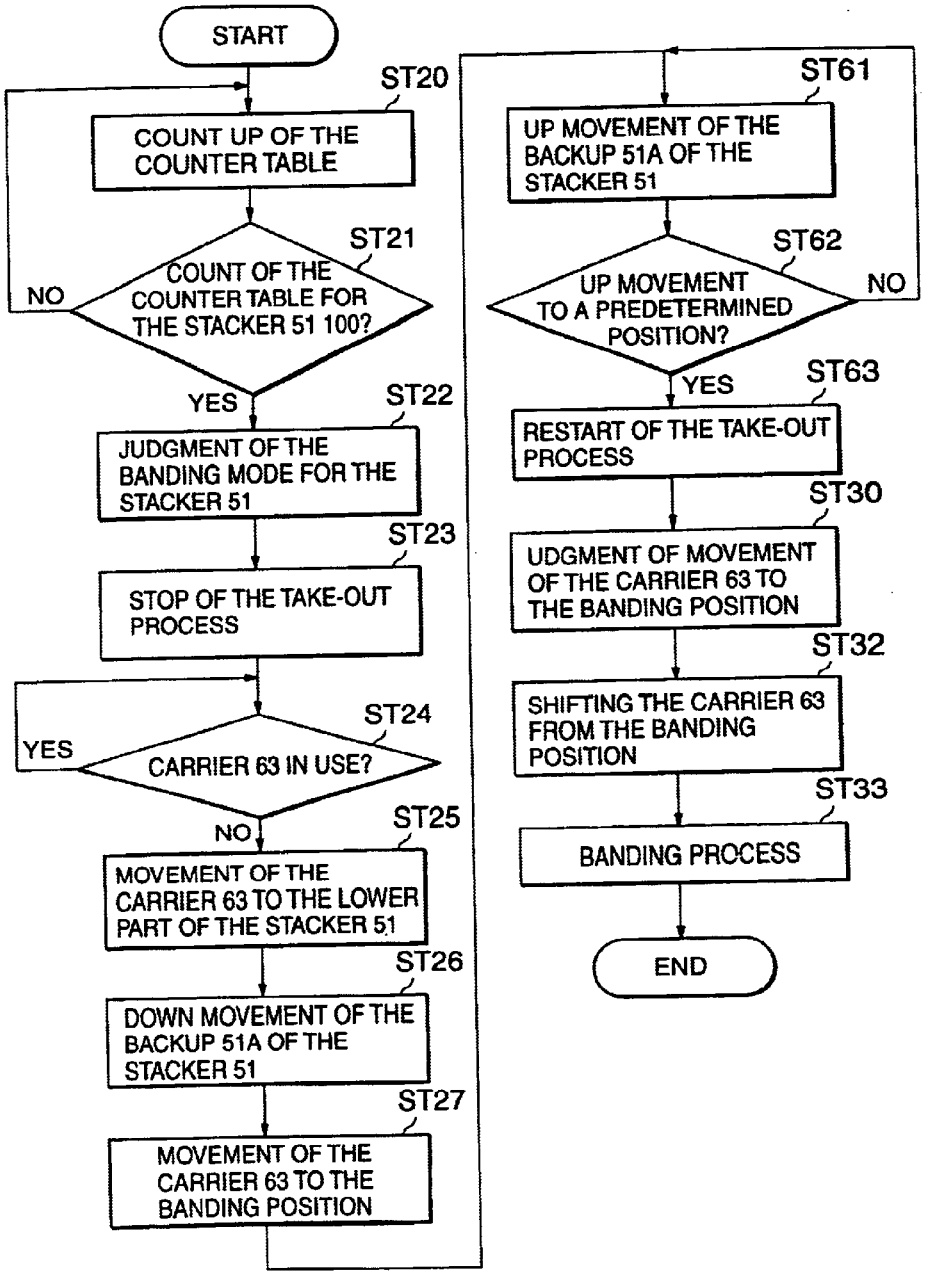
FIG. 13 is a flow chart for explaining the banding process in correspondence with distribution control for two stackers.
Figure 14:
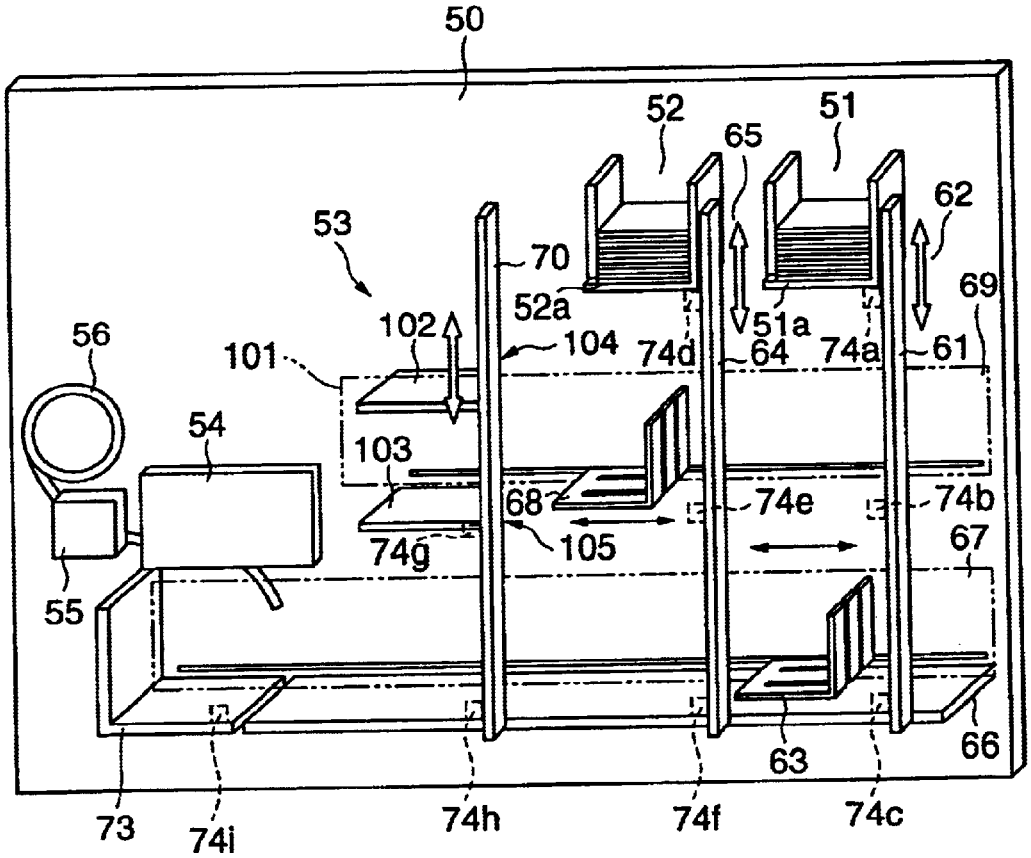
FIG. 14 is a perspective view for explaining the internal constitution of the banding device.

The process when 100 banknotes P are stacked in the stacker 51 in such a constitution will be explained by referring to the flow chart shown in FIG. 13.

Namely, on the basis of the respective judgment results of the "front and back" and "top and bottom" of the banknotes P of a specific money kind, the controller 80 judges the banknotes P to be stacked in the stacker 51. When this judgment is made, the counter table of the memory 81 corresponding to the stacker 51 is counted up (ST20).

In this case, when the count of the counter table 81*a* for the stacker 51 reaches 100 (ST21), the controller 80 judges the banding mode for the stacker 51 (ST22), controls the take-out controller 83, and stops the rotation of the take-out rollers 10 (ST23). And, when the concerned banknotes P are stacked in the stacker 51, the controller 80 judges whether the carrier 63 is in use or not at present (ST24').

When the carrier 63 is not in use as a result of judgment, the controller 80 controls the moving mechanism 67 and moves the carrier 63 to the lower part of the stacker 51 (ST25). Then, the controller 80 controls the moving mechanism 62 and moves down the backup 51*a* of the stacker 51 (ST26). When the backup 51*a* moves down as far as the bottom thereof, the stacked banknotes P on the backup 51*a* of the stacker 51 are transferred onto the carrier 63. After transfer, the controller 80 controls the moving mechanism 67 and moves the carrier 63 to the banding position (ST27). Then, the controller 80 controls the moving mechanism 62 and moves up the backup 51*a* of the stacker 51 (ST61). When the backup 51*a* reaches the detection position by the detector 74*b*, the controller 80 judges restart of take-out, controls the take-out controller 83, and restarts the rotation of the take-out rollers 10 (ST63). By rotation of the take-out rollers 10, the take-out of the banknotes P from the insert port 4 is restarted.

By doing this, when the backup 51*a* moves to the upper stacking position, the banknotes P can be stacked at the stacking position of the stacker 51.

Further, when the controller 80 judges movement of the carrier 63 to the banding position (ST30), the controller 80 controls the moving mechanism (not shown in the drawing) and transfers the stacked banknotes P on the carrier 63 onto the banding tray 73. After transfer, the control 80 controls the moving mechanism 67 and shifts the carrier 63 from the banding position (ST32). Thereafter, the controller 80 controls the banding mechanism 54, thus the stacked banknotes P on the banding tray 73 are banded (ST33). The banded stacked banknotes P are transferred onto the conveyor by a pressing mechanism not shown in the drawing, thereby conveyed out of the apparatus by the conveyor.

When it is judged at Step 24' that the carrier 63 is in use, the controller 80 is put into the standby state.

Between restart of take-in and arrival, the carrier 63 and the backup 51*a* continue the operation and when the backup 51*a* cannot be returned to the stackable position due to operation failure, the conveyed banknotes P drop, so that the conveying is stopped immediately after an occurrence of an error.

Therefore, without waiting for a stackable state, the take-in operation can be re-started earlier by the arrival time from take-in.

Further, in the aforementioned embodiment, the delivery tray 71 is used as a delivery portion as shown in FIG. 4. However, the embodiment is not limited to it and a structure that an upper plate 102 and a lower plate 103 are opened and closed as a delivery portion 101 may also be executed in the same way.

Namely, the delivery portion 101 has a structure that the upper plate 102 and the lower plate 103 are opened and closed and at the time of reception, the delivery portion 101 stands by at an almost same height as that of the carrier 68 in a state that the upper plate 102 is open. In this state, the carrier 68 moves to the left, and when it reaches the position of the delivery portion, the upper plate 102 of the delivery portion 101 moves down and clamps the banknotes P, and the carrier 68 shifts to the right again. By doing this, the movement of the banknotes P from the carrier 68 to the delivery portion 101 is completed.

When the banding operation for the preceding banknotes P is completed, the banknotes P held by the delivery portion 101 are banded. The carrier 63 moves right under the stacker 52 once and the delivery portion 101 moves down to the height of the carrier 63. Next, the carrier 63 moves to the position of the delivery portion 101, further moves to the left after receiving the banknotes P, and moves to the banding position and the banknotes P are banded by the banding mechanism 54.

Figure 15:
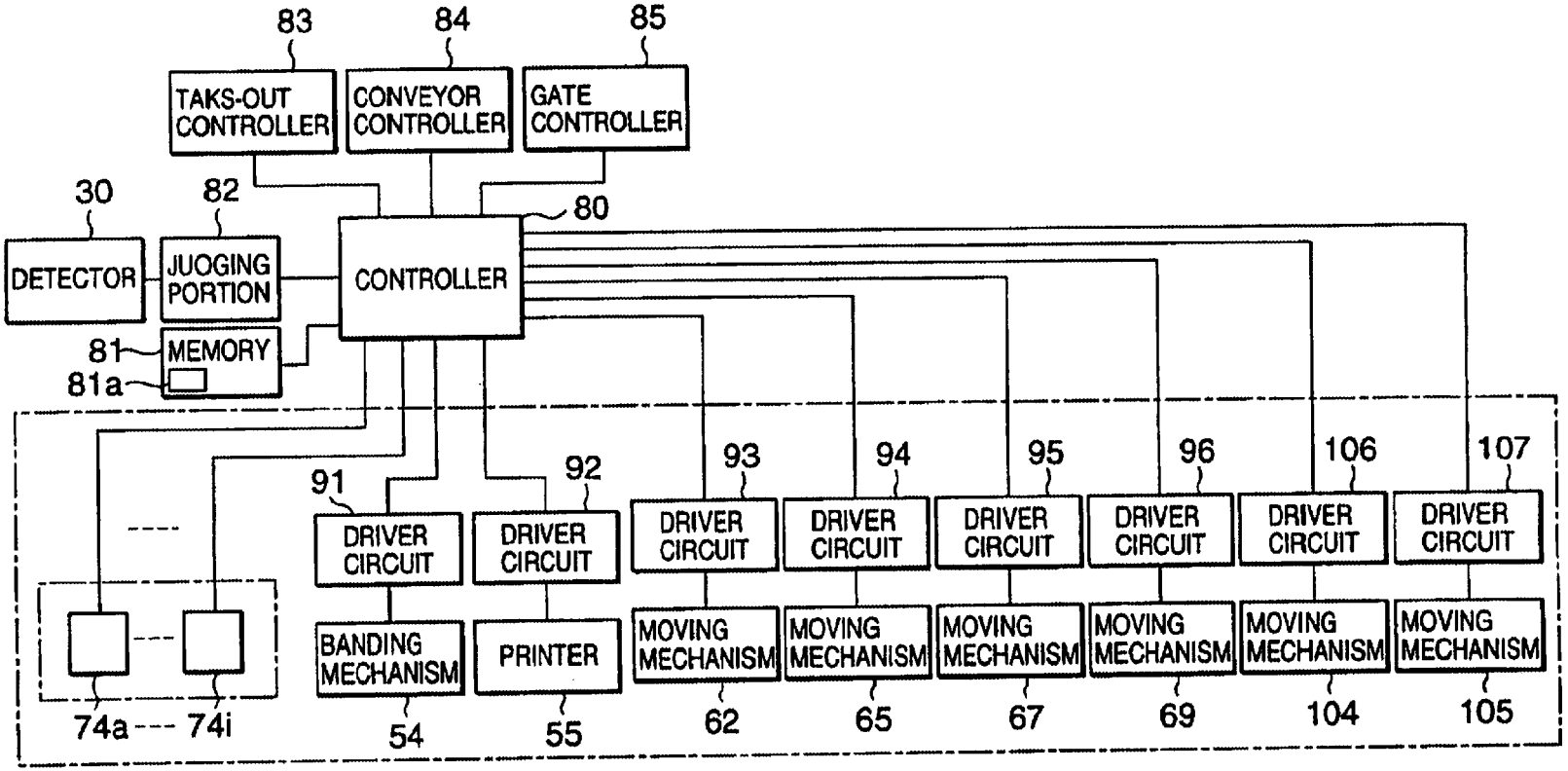
FIG. 15 is a block diagram of the control system for controlling the operation of the banknote processing apparatus.
Figure 16:
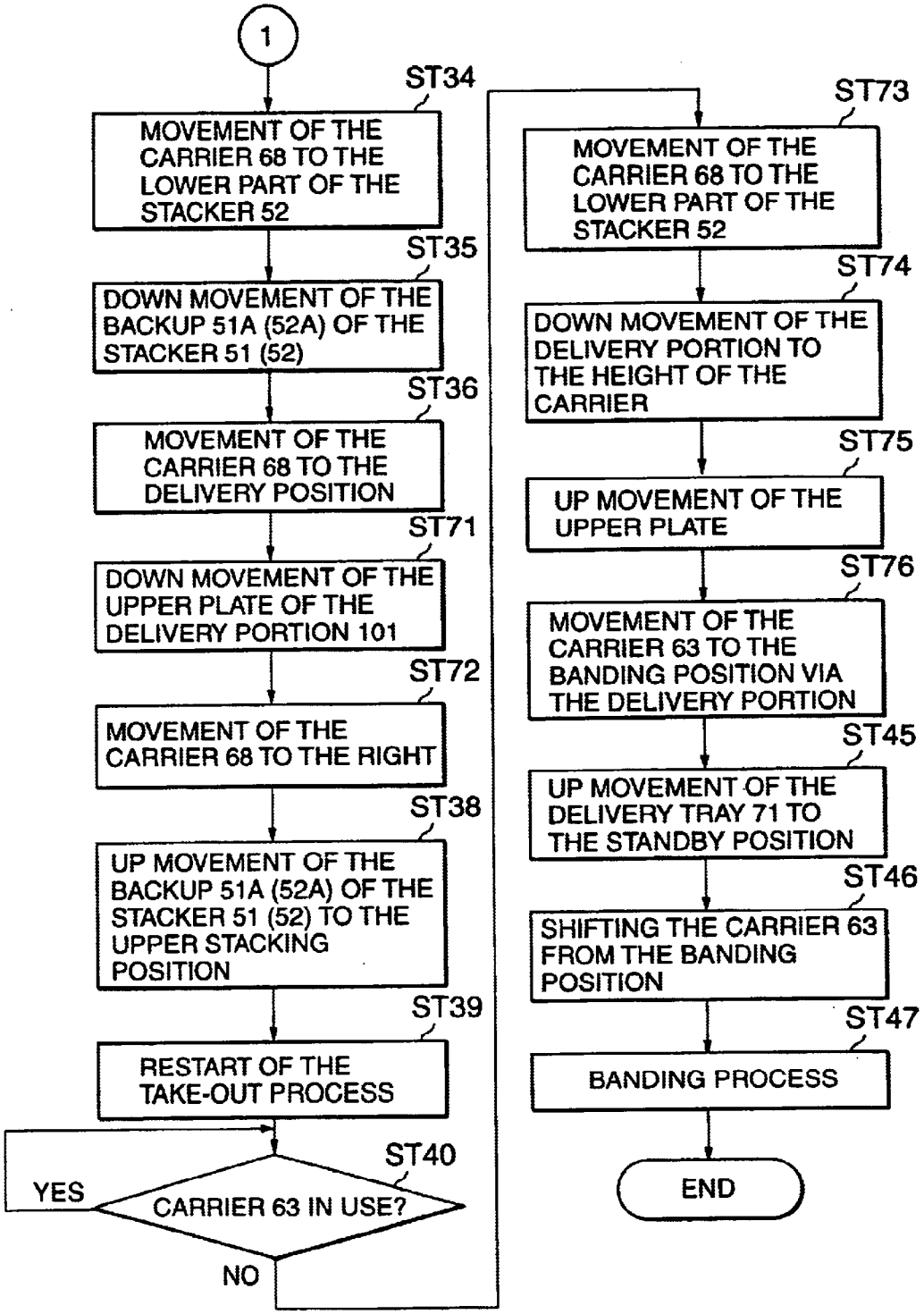
FIG. 16 is a flow chart for explaining the banding process in correspondence with distribution control for two stackers.

Further, in correspondence with deletion of the moving mechanism 72 and addition of moving mechanisms 104 and 105, the control circuit, as shown in FIG. 15, has a constitution that a drive circuit 97 is removed from the constitution shown in FIG. 6 and drive circuits 106 and 107 are added. The process when 100 banknotes P are stacked in the stacker 51 in such a constitution will be explained hereunder by referring to the flow charts shown in FIGS. 8 and 16.

Namely, the controller 80 judges the banknotes P to be stacked in the stacker 51 on the basis of the judgment results respectively of the "front and back" and "top and bottom" of the banknotes P of a specific kind. When the judgment is made, the counter table 81*a* of the memory 81 corresponding to the stacker 51 is counted up (ST20).

In this case, when the count of the counter table 81*a* for the stacker 51 reaches 100 banknotes (ST21), the controller 80 judges the banding mode for the stacker 51 (ST22). Further, the controller 80 controls the take-out controller 83 and stops the rotation of the take-out rollers 10 (ST23). And, when the banknotes P are stacked in the stacker 51, the controller 80 judges whether the carrier is in use or not at present (ST24).

When the carrier 63 is not in use as a result of judgment, the controller 80 controls the moving mechanism 67 and moves the carrier 63 to the lower part of the stacker 51 (ST25). Then, the controller 80 controls the moving mechanism 62 and moves down the backup 51*a* of the stacker 51 (ST26). When the backup 51*a* moves down as far as the bottom thereof, the stacked banknotes P on the backup 51*a* of the stacker 51 are transferred onto the carrier 63. After transfer, the controller 80 controls the moving mechanism 67 and moves the carrier 63 to the banding position (ST27). Then, the controller 80 controls the moving mechanism 62 and moves up the backup 51*a* of the stacker 51 to the upper stacking position (ST28). When the backup 51*a* reaches the stacking position of the stacker 51, the controller 80 judges restart of take-out, controls the take-out controller 83, and restarts the rotation of the take-out rollers 10 (ST29). By rotation of the take-out rollers 10, the take-out of the banknotes P from the insert port 4 is restarted.

Further, when the controller 80 judges movement of the carrier to the banding position (ST30), the controller 80 controls the moving mechanism (not shown in the drawing) and transfers the stacked banknotes P on the carrier 63 onto the banding tray 73. After transfer, the control 80 controls the moving mechanism 67 and shifts the carrier 63 from the banding position (ST32). Thereafter, the controller 80 controls the banding mechanism 54, thus the stacked banknotes P on the banding tray 73 are banded (ST33). The banded stacked banknotes P are transferred onto the conveyor by a pressing mechanism not shown in the drawing, thereby conveyed out of the apparatus by the conveyor.

When the carrier 63 is in use as a result of Step 24, the controller 80 controls the moving mechanism 69 and moves the temporarily holding carrier (temporarily holding portion) 68 to the lower part of the stacker 51 (ST34). Then, the controller 80 controls the moving mechanism 62 and moves down the backup 51*a* of the stacker 51 (ST35). When the backup carrier 51*a* moves down as far as the middle part thereof, the stacked banknotes P on the backup 51*a* of the stacker 51 are transferred onto the carrier 68.

After transfer, the controller 80 controls the moving mechanism 69 and moves the carrier 68 to the delivery position (ST36). In this case, the controller 80 controls the moving mechanisms 104 and 105 and stands by in a state that the lower plate 103 is at an almost same height as that of the bottom of the carrier 68 and the upper plate 102 is open.

Thereafter, when the carrier 68 reaches the position of the delivery portion 101, the controller 80 controls the moving mechanism 104 and moves down the upper plate 102 of the delivery portion 101 (ST71). The banknotes P on the carrier 68 are clamped by the upper plate 102 and the lower plate 103. In this state, the controller 80 controls the moving mechanism 69 and moves the carrier 68 to the right (ST72). By the movement of the carrier 68 to the right (shifting from the delivery portion 101), the movement from the carrier 68 to the delivery portion 101 is completed.

After the carrier 68 moves to the delivery position, the controller 80 moves up the backup 51*a* of the stacker 51 to the upper stacking position (ST38). When the backup 51*a* reaches the stacking position of the stacker 51, the controller 80 judges restart of take-out, controls the take-out controller 83, and restarts the rotation of the take-out rollers 10 (ST39). By rotation of the take-out rollers 10, the take-out of the banknotes P from the insert port 4 is restarted.

When the controller 80 judges thereafter that the carrier 63 is not in use (usable) (ST40), the controller 80 controls the moving mechanism 67 and moves the carrier 63 to the lower part of the stacker 52 (ST73). Then, the controller 80 controls the moving mechanisms 104 and 105 and moves down the delivery portion 101 to the height of the carrier 68 (ST74).

When the delivery portion 101 moves down to the height of the carrier 63, the controller 80 controls the moving mechanism 104 and moves up the upper plate 102 of the delivery portion 101 (ST75). By rising of the upper plate 102, the clamping of the banknotes P by the upper plate 102 and the lower plate 103 is released. In this state, the controller 80 controls the moving mechanism 67 and moves the carrier 63 to the banding position via the delivery portion 101 (ST76). By doing this, the stacked banknotes P on the delivery portion 101 are transferred onto the carrier 63 and after transfer, further moved to the banding position by the carrier 63. Then, the controller 80 controls the moving mechanisms 104 and 105 and moves up the delivery portion 101 to the standby position (ST45).

Further, when the controller 80 judges movement of the carrier 63 to the banding position, the controller 80 controls the moving mechanism (not shown in the drawing) and transfers the stacked banknotes P on the carrier 63 onto the banding tray 73. After transfer, the control 80 controls the moving mechanism 67 and shifts the carrier 63 from the banding position (ST46). Thereafter, the controller 80 controls the banding mechanism 54, thus the stacked banknotes P on the banding tray 73 are banded (ST47). The banded stacked banknotes P are transferred onto the conveyor by a pressing mechanism not shown in the drawing, thereby conveyed out of the apparatus by the conveyor.

As described above in detail, the present invention can provide a paper-like material processing apparatus for properly arranging the "front and back" and "top and bottom" of all paper-like materials without changing the apparatus constitution and banding all paper-like materials at the same position commonly by a single banding device.

Further, the present invention can provide a paper-like material processing apparatus for shortening the stop time of the stacking process for paper-like materials when the banding process is to be executed for paper-like materials stacked in one stacker and the other stacker almost at the same time.

What is claimed is:

1. A paper-like material processing apparatus, comprising:

a discriminator to discriminate a kind of paper-like materials to be conveyed;

a first stacker to stack the paper-like materials discriminated as a first kind on the basis of discrimination results of the discriminator;

a second stacker to stack the paper-like materials discriminated as a second kind on the basis of the discrimination results of the discriminator; and a single banding mechanism to band respectively paper-like materials stacked in the first stacker and the second stacker.

2. The apparatus according to claim 1, wherein the first kind means a paper-like material in a state that "top and bottom" are properly arranged and a front is positioned up and the second kind means a paper-like material in a state that "top and bottom" are properly arranged and a back is positioned up.

3. The apparatus according to claim 1, wherein the first kind means a first banknote indicating a first money kind and the second kind means a second banknote indicating a second money kind different from the first money kind.

4. A paper-like material processing apparatus, comprising:

an insert port that a plurality of rectangular paper-like materials having a front and back and an upper end and lower end extending in a longitudinal direction are inserted in a batch;

a take-out portion to take out the paper-like materials inserted into the insert port one by one with the upper end or the lower end positioned up;

a conveying path to convey the paper-like materials taken out from the take-out portion with the upper end or the lower end positioned up;

a detector to detect information concerning "front and back" and "top and bottom" of the paper-like materials conveyed on the conveying path;

a front/back reversing portion to selectively reverse the front and back of the paper-like materials conveyed on the conveying path on the basis of the detected results by the detector;

first and second stackers to stack the paper-like materials whose front and back are selectively reversed by the front/back reversing portion;

a distributor to distribute the paper-like materials conveyed on the conveying path to either of the first and second stackers on the basis of the detection results by the detector; and a single banding portion to band the paper-like materials stacked in the first and second stackers at a biased position on one side in the longitudinal direction for each predetermined number.

5. The apparatus according to claim 4, further comprising:

a controller to control the front/back reversing portion and the distributor so as stack paper-like materials in a state that "top and bottom" are properly arranged and a front is positioned up in the first stacker and paper-like materials in a state that "top and bottom" are properly arranged and a back is positioned up in the second stacker.

6. The apparatus according to claim 4, wherein the paper-like materials are banknotes.

7. A paper-like material processing apparatus, comprising:

a discriminator to discriminate paper-like materials to be conveyed;

a first stacker to stack the paper-like materials on the basis of discrimination results of the discriminator;

a second stacker to stack the paper-like materials on the basis of the discrimination results of the discriminator;

a single banding mechanism to band the paper-like materials stacked in the first stacker and the second stacker;

a conveying mechanism to, when a number of stacked paper-like materials in the first and second stackers reaches a predetermined number, receive the paper-like materials and convey the paper-like materials to the banding mechanism; and a temporarily holder to, when the number of stacked paper-like materials in one of the first and second stackers reaches the predetermined number during a conveying operation by the conveying mechanism, receive the paper-like materials in the stacker and temporarily hold the paper-like materials and after the conveying operation by the conveying mechanism ends, transfer the temporarily held paper-like materials to the conveying mechanism.

8. The apparatus according to claim 7, wherein the paper-like materials in a state that "top and bottom" are properly arranged and a front is positioned up are stacked in the first stacker and the paper-like materials in a state that "top and bottom" are properly arranged and a back is positioned up are stacked in the second stacker.

9. The apparatus according to claim 7, wherein the paper-like materials are banknotes.

10. A paper-like material processing apparatus, comprising:

an insert port that a plurality of paper-like materials are inserted in a batch;

a take-out portion to take out the paper-like materials inserted into the insert port one by one;

a conveying path to convey the paper-like materials taken out from the take-out portion;

a detector to detect information of the paper-like materials conveyed on the conveying path;

first and second stackers to selectively stack the paper-like materials conveyed on the conveying path on the basis of the detection results by the detector;

a distributor to distribute the paper-like materials conveyed on the conveying path to either of the first and second stackers on the basis of the detection results by the detector;

a single banding portion to band the paper-like materials stacked in the first and second stackers for each predetermined number;

a conveying mechanism to, when a number of stacked paper-like materials in the first and second stackers reaches a predetermined number, receive the paper-like materials and convey the paper-like materials to the banding mechanism; and a temporarily holder to, when the number of stacked paper-like materials in one of the first and second stackers reaches the predetermined number during a conveying operation by the conveying mechanism, receive the paper-like materials in the stacker and temporarily hold the paper-like materials and after the conveying operation by the conveying mechanism ends, transfer the temporarily held paper-like materials to the conveying mechanism.

11. The apparatus according to claim 10, wherein the paper-like materials in a state that "top and bottom" are properly arranged and a front is positioned up are stacked in the first stacker and the paper-like materials in a state that "top and bottom" are properly arranged and a back is positioned up are stacked in the second stacker.

12. A paper-like material processing apparatus, comprising:

an insert port that a plurality of paper-like materials are inserted in a batch;

a take-out portion to take out the paper-like materials inserted into the insert port one by one;

a conveying path to convey the paper-like materials taken out from the take-out portion;

a detector to detect information of the paper-like materials conveyed on the conveying path;

first and second stackers to selectively stack the paper-like materials conveyed on the conveying path on the basis of the detection results by the detector;

a distributor to distribute the paper-like materials conveyed on the conveying path to either of the first and second stackers on the basis of the detection results by the detector;

a single banding portion to band the paper-like materials stacked in the first and second stackers for each predetermined number;

a conveying mechanism to, when a number of stacked paper-like materials in the first and second stackers reaches a predetermined number, receive the paper-like materials and convey the paper-like materials to the banding mechanism;

a stopper to stop taking-out of the paper-like materials by the take-out portion during the conveying operation by the conveying mechanism; and a re-starter to restart taking-out the paper-like materials by the take-out portion earlier than a stackable time of the paper-like materials into the first and second stackers in correspondence with an end of the banding operation by the banding mechanism by a time required to take out the paper-like materials by the take-out portion and convey the paper-like materials to the first and second stackers.

13. The apparatus according to claim 12, wherein the paper-like materials in a state that "top and bottom" are properly arranged and a front is positioned up are stacked in the first stacker and the paper-like materials in a state that "top and bottom" are properly arranged and a back is positioned up are stacked in the second stacker.

* * * * *